US011267042B2

(12) United States Patent
Honsa et al.

(10) Patent No.: US 11,267,042 B2
(45) Date of Patent: Mar. 8, 2022

(54) END EFFECTOR

(71) Applicant: Honsa Ergonomic Technologies, Inc., Milan, IL (US)

(72) Inventors: Thomas W. Honsa, Milan, IL (US); Brett A. Casper, Rock Island, IL (US)

(73) Assignee: Honsa Ergonomic Technologies, Inc., Milan, IL (US)

( * ) Notice: Subject to any disclaimer, the term of this patent is extended or adjusted under 35 U.S.C. 154(b) by 130 days.

(21) Appl. No.: 16/664,149

(22) Filed: Oct. 25, 2019

(65) Prior Publication Data

US 2020/0164425 A1 May 28, 2020

Related U.S. Application Data

(63) Continuation-in-part of application No. 16/247,541, filed on Jan. 14, 2019, now Pat. No. 10,828,692, which is a continuation of application No. 14/207,589, filed on Mar. 12, 2014, now Pat. No. 10,179,361.

(60) Provisional application No. 62/750,664, filed on Oct. 25, 2018, provisional application No. 61/906,268, filed on Nov. 19, 2013, provisional application No. 61/777,070, filed on Mar. 12, 2013.

(51) Int. Cl.

| | |
|---|---|
| ***B21J 15/36*** | (2006.01) |
| ***B21J 15/02*** | (2006.01) |
| ***B21J 15/40*** | (2006.01) |

(52) U.S. Cl.

CPC ..... *B21J 15/36* (2013.01); *B21J 15/02* (2013.01); *B21J 15/40* (2013.01); *Y10T 29/53774* (2015.01)

(58) Field of Classification Search

CPC ... B21J 15/02; B21J 15/36; B21J 15/40; B21J 15/105; B21J 15/383; B21J 11/007

See application file for complete search history.

(56) References Cited

U.S. PATENT DOCUMENTS

| | | | |
|---|---|---|---|
| 1,156,142 | A | 10/1915 | Hughes |
| 1,179,839 | A | 4/1916 | Kamosis |
| 1,441,117 | A | 1/1923 | John |
| 2,183,543 | A | 12/1939 | Cherry |
| 2,310,625 | A | 2/1943 | Fischer |
| 2,430,532 | A | 11/1947 | W |
| 2,576,786 | A | 11/1951 | Gray |

(Continued)

FOREIGN PATENT DOCUMENTS

| | | |
|---|---|---|
| DE | 612224 | 4/1935 |
| GB | 2492578 A | 1/2013 |

(Continued)

OTHER PUBLICATIONS

International Search Report and Written Opinion for PCT/US2014/025125, dated Jul. 17, 2014.

*Primary Examiner* — Tyrone V Hall, Jr.

(74) *Attorney, Agent, or Firm* — Hamilton IP Law, PC; Jay R. Hamilton; Charles A. Damschen

(57) ABSTRACT

An end effector may be configured to be modular in nature such that the weight of the end effector may be adjusted for specific applications. The end effector may further be configured to accept interchangeable dollies, wherein a dolly may be configured with a jacket on a contact end of the dolly, which contact end is configured to engage a distal end of a rivet during use.

12 Claims, 30 Drawing Sheets

(56) References Cited

U.S. PATENT DOCUMENTS

| | | | | |
|---|---|---|---|---|
| 2,744,718 | A | 5/1956 | Markowski | |
| 2,925,748 | A | 2/1960 | Ross | |
| 3,085,217 | A | 4/1963 | Boode et al. | |
| 3,695,499 | A | 10/1972 | Taylor | |
| 3,724,738 | A | 4/1973 | Hurst | |
| 4,170,920 | A | 10/1979 | Siebol | |
| 4,218,911 | A | 8/1980 | Johnston | |
| 4,493,205 | A | 1/1985 | Ramey | |
| 4,562,948 | A | 1/1986 | Floyd | |
| 4,635,732 | A | 1/1987 | Gotsch et al. | |
| 4,709,841 | A | 12/1987 | Wollar | |
| 4,885,836 | A | 12/1989 | Bonomi et al. | |
| 4,955,119 | A | 9/1990 | Bonomi et al. | |
| 4,995,148 | A | 2/1991 | Bonomi et al. | |
| 5,299,464 | A | 4/1994 | Bennett | |
| 5,357,666 | A | 10/1994 | Dessouky et al. | |
| 5,588,323 | A * | 12/1996 | Peterson | B21J 15/30 29/243.53 |
| 5,771,551 | A | 6/1998 | Schurter et al. | |
| 5,813,477 | A | 9/1998 | Clay et al. | |
| 5,875,674 | A * | 3/1999 | Ayers, Jr. | B21J 15/36 72/477 |
| 6,036,073 | A | 3/2000 | Newhouse | |
| 6,092,964 | A | 7/2000 | Dessouky et al. | |
| 6,192,997 | B1 | 2/2001 | Tsai et al. | |
| 6,234,256 | B1 | 5/2001 | Kettner | |
| 6,276,050 | B1 | 8/2001 | Mauer et al. | |
| 6,668,942 | B1 | 12/2003 | Lin | |
| 7,610,968 | B1 | 11/2009 | Honsa | |
| 7,775,412 | B2 | 8/2010 | Nemeth | |
| 2004/0034977 | A1 | 2/2004 | Heck et al. | |
| 2004/0139590 | A1 | 7/2004 | Eldessouky | |
| 2004/0223832 | A1 | 11/2004 | Aasgaard | |
| 2006/0090318 | A1 | 5/2006 | Toosky et al. | |
| 2006/0218780 | A1 | 10/2006 | Lewis et al. | |
| 2009/0031545 | A1 | 2/2009 | Keppel | |
| 2010/0275424 | A1 | 11/2010 | Masugata | |
| 2012/0267136 | A1 | 10/2012 | Mossnang | |
| 2013/0167610 | A1 | 7/2013 | Sarh et al. | |

FOREIGN PATENT DOCUMENTS

| | | | |
|---|---|---|---|
| JP | 05013640 | U | 2/1993 |
| KR | 1020090027763 | A | 3/2009 |

* cited by examiner

50'
54a'
52'
56'
100

END EFFECTOR

CROSS REFERENCE TO RELATED APPLICATIONS

The present non-provisional utility patent application claims priority from and is a continuation-in-part of U.S. patent application Ser. No. 16/247,541 filed on Jan. 14, 2019, which application is a continuation of and claimed priority from U.S. patent application Ser. No. 14/207,589 filed on Mar. 12, 2014, now U.S. Pat. No. 10,179,361 issued Jan. 15, 2019, which claimed priority from provisional U.S. Pat. App. No. 61/777,070 filed Mar. 12, 2013 and provisional U.S. Pat. App. No. 61/906,268 filed Nov. 19, 2013, all of which are incorporated by reference herein in their entireties. The present application also claims priority from provisional U.S. Pat. App. No. 62/750,664, filed on Oct. 25, 2018, which is incorporated by reference herein in its entirety.

FIELD OF INVENTION

The present invention relates to hand tools, and more specifically to end effectors, which may be referred to as bucking bars.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Rivets

By way of background and without limitation, the End Effector 10 disclosed may be used for the installation of rivets which are a permanent mechanical fastener. Before being installed, a rivet consists of a smooth cylindrical shaft with a head on one end. The end opposite the head is called the buck-tail. On installation the rivet is placed in a punched or drilled hole, and the tail is upset, or bucked (i.e., deformed), so that it expands to about 1.5 times the original shaft diameter, holding the rivet in place. To distinguish between the two ends of the rivet, the original head is called the factory head and the deformed end is called the shop head or buck-tail. Because there is effectively a head on each end of an installed rivet, it can support tension loads (loads parallel to the axis of the shaft); however, it is much more capable of supporting shear loads (loads perpendicular to the axis of the shaft). A flush rivet is used primarily on external metal surfaces (aka "work piece") where good appearance and the elimination of unnecessary aerodynamic drag are important. A flush rivet takes advantage of a countersink hole; they are also commonly referred to as countersunk rivets. Countersunk or flush rivets are used extensively on the exterior of aircraft for aerodynamic reasons. Additional post-installation machining may be performed to perfect the airflow. (As discussed in further detail at http://en.wikipedia.org/wiki/Rivet)

Vibration Reduction

Numerous studies of the vibration problem and attempted solutions thereto have been essayed, directed mainly to the provision of various forms of shock-absorbing materials interposed between the tool handle and the moving part of the tool. Typical of such part-solutions is the disclosure in U.S. Pat. No. 3,968,843 issued to Shotwell, wherein a block of rubber is disposed between the handle and barrel of a pneumatic percussion tool. Applicant has attempted other solutions to the vibration problem as disclosed in U.S. Pat. Nos. 4,648,468; 4,771,833; 4,905,772 5,027,910; 5,031,323; 5,054,562; 7,401,662; and, 7,610,968, all of which are incorporated by reference herein in their entireties.

BRIEF DESCRIPTION OF THE FIGURES

In order that the advantages of the present disclosure will be readily understood, a more particular description of various illustrative embodiments briefly described above will be rendered by reference to specific embodiments illustrated in the appended drawings. Understanding that these drawings depict only typical embodiments and are not therefore to be considered limiting of its scope unless otherwise indicated in the following claims, the illustrative embodiments will be described and explained with additional specificity and detail through the use of the accompanying drawings.

FIG. 17BB is an end view of the embodiment of an end effector shown in FIGS. 17A & 17B.

DETAILED DESCRIPTION—LISTING OF ELEMENTS

Figure 1:
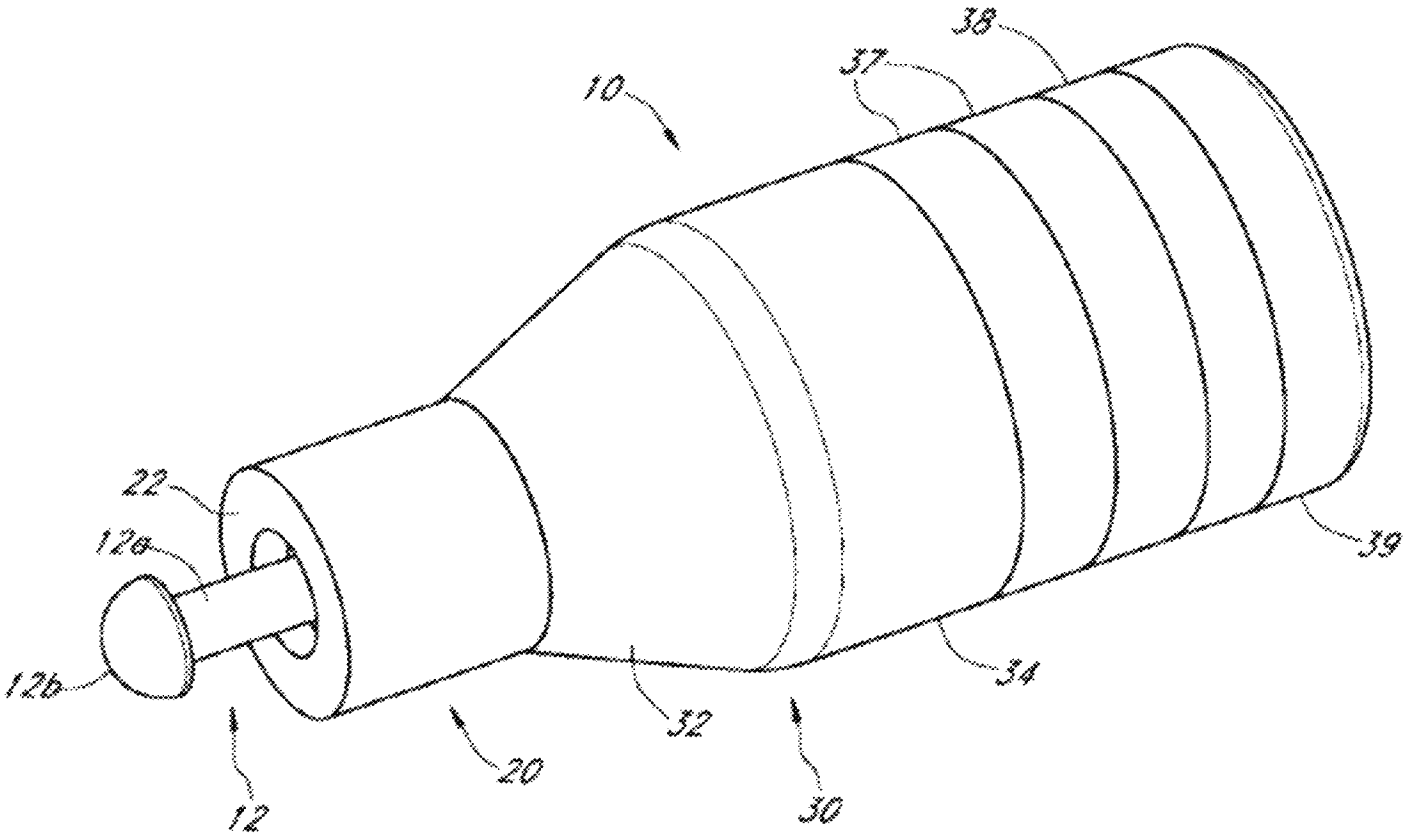
FIG. 1 provides a perspective view of a first embodiment of an end effector in accordance with the present disclosure.

| ELEMENT DESCRIPTION | ELEMENT # |
|---|---|
| End Effector | 10, 10' |
| Rivet | 12 |
| Shaft | 12a |
| Head | 12b |
| Distal end | 12c |
| Work piece | 14 |
| Aperture | 15 |
| Biasing member | 16, 16' |
| O-ring | 17 |
| Sleeve | 18 |
| Tip | 20 |
| Ridge | 21 |
| Ramp | 21a |
| Work piece contact surface | 22 |

-continued

| ELEMENT DESCRIPTION | ELEMENT # |
|---|---|
| Central bore | 24 |
| Fitting | 26 |
| Ledge | 26a |
| Second ledge | 26b |
| Locator | 28 |
| Housing neck | 30, 30' |
| Neck first portion | 32 |
| Neck second portion | 34 |
| Annular ring | 35 |
| Neck bore | 36, 36' |
| Bore shelf | 36a |
| Bore contour | 36b |
| Housing section | 37, 37' |
| Lip | 37a |
| Groove | 37b |
| End section | 38, 38' |
| End section seat | 38a |
| Cap | 39, 39' |
| Main insert | 40 |
| Intermediate insert | 40a, 40a' |
| End insert | 40b, 40b' |
| Contact Insert | 41 |
| Insert neck | 42 |
| Shell | 43 |
| Annular groove | 44, 44' |
| Cup | 46 |
| Cup wall | 46a |
| End insert external surface | 48 |
| Insert section seat | 48a |
| Bolt | 49 |
| Dolly | 50, 50' |
| Bore | 51 |
| Shank | 52' |
| First end | 54' |
| Keyway | 54a' |
| Contact end | 56' |
| Contact surface | 56a' |
| Contact end groove | 56b' |
| Nose insert | 60 |
| Nose insert bore | 61 |
| Tapered portion | 62 |
| Nose insert keyway | 63 |
| Nose annular groove | 64 |
| Keeper | 66 |
| Guide member | 70 |
| Internal channel | 71 |
| Flange | 72 |
| Body | 74 |
| Flat portion | 74a |
| Jacket | 100 |
| Work piece contact surface | 102 |
| Recessed portion | 103 |
| Jacket ridge | 104 |
| Lip | 105 |
| Jacket height limit | 106 |
| Jacket side | 108 |
| End Effector | 110 |
| Work end | 112 |
| Work end face | 112a |
| Work end groove | 112b |
| Grip portion | 114 |

DETAILED DESCRIPTION

Before the present methods and apparatuses are disclosed and described, it is to be understood that the methods and apparatuses are not limited to specific methods, specific components, or to particular implementations. It is also to be understood that the terminology used herein is for the purpose of describing particular embodiments/aspects only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

"Aspect" when referring to a method, apparatus, and/or component thereof does not mean that limitation, functionality, component etc. referred to as an aspect is required, but rather that it is one part of a particular illustrative disclosure and not limiting to the scope of the method, apparatus, and/or component thereof unless so indicated in the following claims.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and apparatuses. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and apparatuses. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and apparatuses may be understood more readily by reference to the following detailed description of preferred aspects and the examples included therein and to the Figures and their previous and following description. Corresponding terms may be used interchangeably when referring to generalities of configuration and/or corresponding components, aspects, features, functionality, methods and/or materials of construction, etc. those terms.

It is to be understood that the disclosure is not limited in its application to the details of construction and the arrangements of components set forth in the following description or illustrated in the drawings. The present disclosure is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 provides a perspective view of a first illustrative embodiment of an end effector 10 (sometimes referred to as a "bucking bar" in reference to the installation of Rivets). Generally, it is contemplated that the end effector 10 may be used to spread the distal end 12*c* of the shaft 12*a* of a rivet 12 to form what is commonly referred to as a "nugget" or "butt," which may work in concert with a head 12*b* to retain the rivet 12 within an aperture in a work piece. The energy required to spread the distal end 12*c* of the rivet 12 is often provided via a pneumatic hammer or rivet gun (not shown) acting on the head 12*b*, but the scope of the end effector 10 as disclosed herein is not limited by the structure and/or method used to provide the energy required to spread the distal end 12*c* of the rivet 12. The end effector 10 subject of the present disclosure has been found to produce a desirable nugget or butt during installation of a rivet 12 and due to its superior ergonomic design, reduce the attendant stress upon the user of the end effector (not shown) delivered by the pneumatic hammer or rivet gun (not shown).

Generally, during use the tip 20 is positioned adjacent the rivet 12. A housing neck 30 may be engaged with the tip 20 at a first end of the housing neck 30. A housing section 37 may be engaged with the housing neck 30 opposite the tip 20, and one or more housing sections 37 may be positioned between the housing neck 30 and an end section 38. It is contemplated that a user will primarily grasp the end effector 10 about the housing neck 30, housing section(s) 37, end section 38, and/or cap 39 during use.

Figure 2:
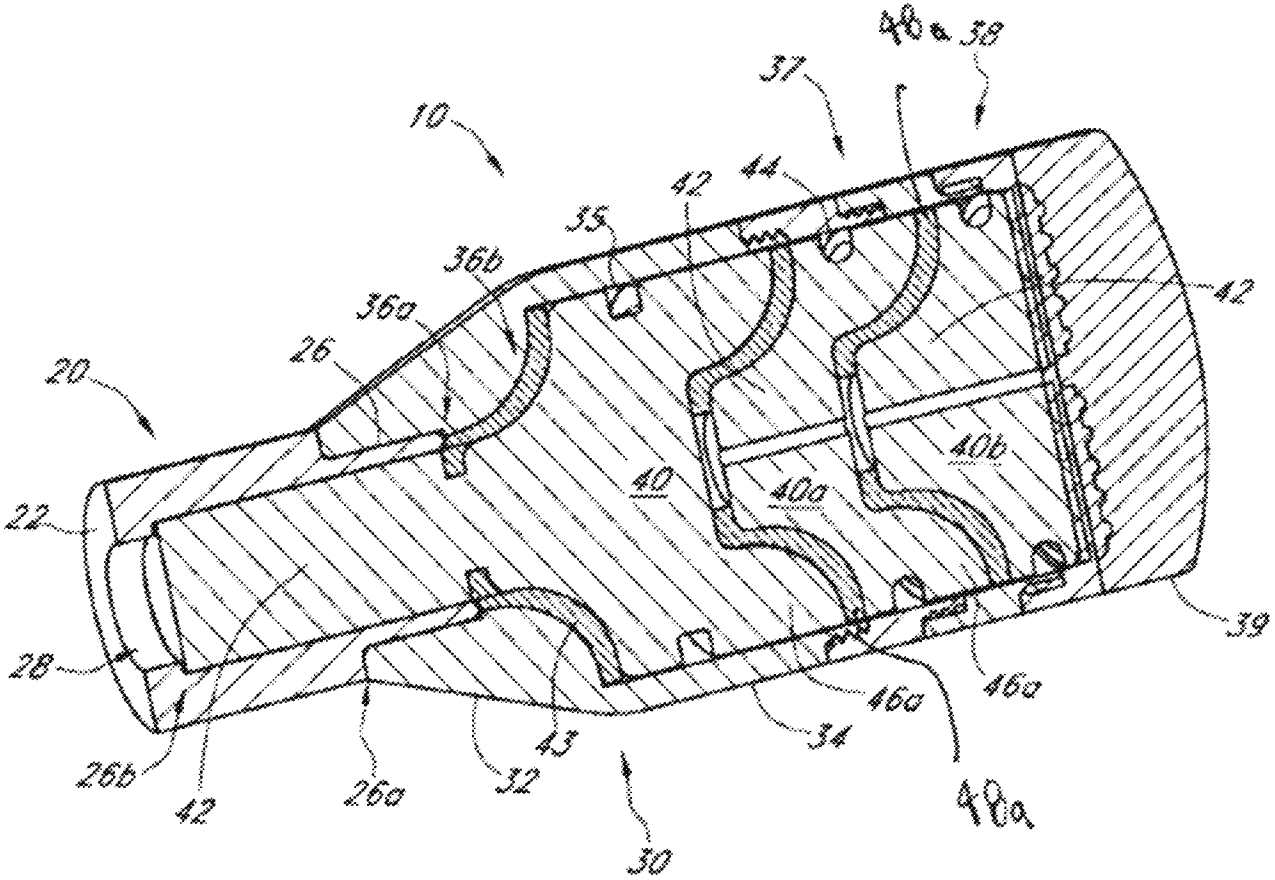
FIG. 2 provides a side, cross-sectional view of the first embodiment of an end effector in accordance with the present disclosure.
Figure 3:
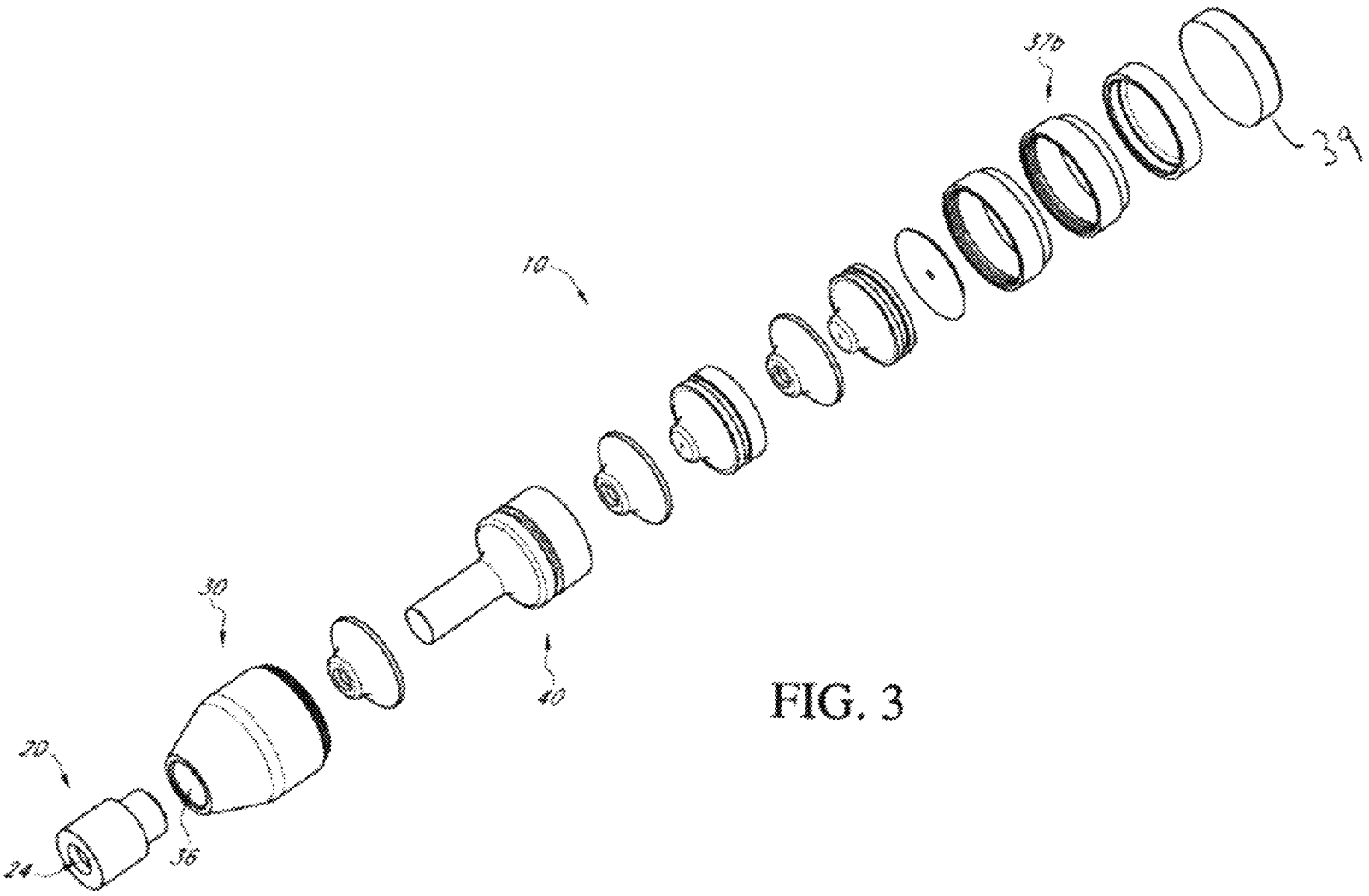
FIG. 3 provides a perspective, exploded view of the first embodiment of an end effector in accordance with the present disclosure.

Referring now to FIGS. 2 & 3, the tip 20 of the first illustrative embodiment of the end effector 10 may be configured with a central bore 24. A first end of the tip 20 may be configured with a work piece contact surface 22 generally shaped as a ring around the central bore 24, which may be designed to contact the work piece through which the rivet 14 passes. It is contemplated that the tip 20 may be constructed of a synthetic material designed not to mar or damage the surface of the work piece when the distal end 12*c* of the rivet 12 is spread. Accordingly, the optimal material will vary from one application of the end effector 10 to the next, and therefore is not limiting to the scope of the end effector 10. Additionally, the tip 20 may be configured so that it is transparent so that the user may see the engagement between the rivet 10 and the insert neck 42 of the main insert 40. Such a tip 20 may also be configured to magnify the rivet 12 to assist the user.

Materials used to construct the tip 20 include but are not limited to elastomeric polymers, cellulosic materials, and/or combinations thereof. When the work piece contact surface 22 is in contact with the work piece (not shown), it is contemplated that the end effector 10 will be configured such that a portion of the distal end 12*c* of the rivet 12 will be located within a portion of the central bore 24, as best shown in FIG. 2, which is referred to as a locator 28 and is described in more detail below.

The tip 20 may be engaged with a housing neck 30 about a fitting 26. The tip 20 may include a ledge 26*a*, which may be formed at the base of the fitting 26 to engage a neck first portion 32 of the housing neck 30. The tip 20 may also include a second ledge 26*b* formed in the central bore 24 intermediate with respect to the work piece contact surface 22 and the fitting 26 to engage a portion the main insert 40, as described in further detail below.

The housing neck 30 may include a neck second portion 34, which may be generally cylindrical in shape. The neck second portion 34 may be engaged with the neck first portion 32 as shown in FIGS. 1-3 and be configured with a neck bore 36 along the longitudinal axis thereof, which axis may be parallel to that of the central bore 24 of the tip 20. The configuration of the tip 20 as shown herein is for illustrative purposes only, and the scope of the end effector 10 is in no way limited to that as shown herein throughout the various figures. The internal surface of the housing neck 30 may be formed with a radiused bore contour 36*b* on the neck first portion 32 adjacent the bore shelf 36*a*. However, the scope of the housing neck 30 is not so limited and applies any configuration on the interior surface of the neck housing 30.

In the illustrative embodiments of the end effector 10, the tip 20 and housing neck 30 may be configured such that the fitting 26 of the tip 20 fits within the neck bore 30. In the illustrative embodiments, the fitting 26 and neck bore 30 may be generally cylindrical in shape, but the scope of the end effector 10 as disclosed and claimed herein is not so limited. The distal end of the fitting 26 may engage a bore shelf 36*a* formed in the neck bore 36 on the interior side of the neck bore 36 at the neck first portion 32. The distal end of the housing neck 30 may correspondingly engage the ledge 26*a* formed in the tip 20. The tip 20 may be engaged with the housing neck 30 thereby via an interference fit (aka "snap and click"). One of ordinary skill will appreciate the value and benefit of the snap and click attributes of the tip 20 as the modularity of the end effector 10 disclosed herein contemplates a large range of uses and sizes while still allowing secure engagement with the distal end of rivets 12, having variation in diameter and distal length, attributable as discussed further herein by the combination of the replaceable/swappable tip 20, the structure the of the locator 28 and the work piece contact surface 22 as well as the modular nature of the housing and housing sections as well as the main insert 40, intermediate insert 40*a*, end insert 40*b* and contact insert 41, to produce the rounded nugget or butt desired.

One of ordinary skill will also appreciate that although modularity of the housing and inserts and interchangeability of the tips is desirable, the present disclosure contemplates, without limitation or restriction the securing the tip 20 to the housing neck 30 using any suitable method and/or apparatus, including but not limited to screws, chemical adhesives, fasteners, and/or combinations thereof.

The terminal portion of the neck second portion 34 may be formed with a groove 37*b* therein for engagement with a housing section 37 or end section 38, as described in detail below. It is contemplated that a plurality of tips 20 having different configurations may be interchangeable with one another on a single end effector 10 and the tips 20 may have different dimensions, in both diameter and depth, as well as different configurations, to allow engagement with a range of rivets or other fasteners, having a range of sizes, as well as a range of work pieces having different requirements for work thereon.

A housing section 37 may be engaged with the housing neck 30 adjacent the neck second portion 34, as best shown in FIGS. 1&2, and/or adjacent housing sections 37 and/or an end section 38. Each housing section 37 may be formed with a lip 37*a* on a first end and a groove 37*b* on the second end such that the lip 37*a* from one housing section 37 fits into the groove 37*b* of an adjacent section. The lip 37*a* and groove 37*b* on adjacent housing sections 37 may have cooperating threads thereon to engage one another in a secure manner. Any structure and/or method may be used to engage one housing section 37 with another housing section 37, housing neck 30, and/or end section 38 without limitation. The first illustrative embodiment of the end effector 10 includes two housing sections 37 and one end section 38, but the number of housing sections 37 and/or end sections 38 in no way limits the scope of the end effector 10 as disclosed and claimed herein. Furthermore, the illustrative embodiments of the end effector 10 are designed to be modular, allowing the user to dictate the number of housing section 37, as further described below.

The end section 38 may be formed with a lip 37*a* around the periphery thereof. An end section seat 38*a* may be formed on the interior axial face of the end section 38. The end section seat 38*a* may be formed of an elastomeric polymer or other suitable material with suitable material characteristics for the specific application of the end effector 10. Alternatively, the end section seat 38*a* may be formed as a spring, or some other type of structure to absorb a specific amount of energy during spreading of the rivet 12 distal end 12*c*. A cap 39 may be formed on the exterior axial surface of the end section 38. The cap 39 may be formed of an elastomeric polymer or other suitable material with suitable material characteristics for the specific application of the end effector 10.

A main insert 40 may be positioned within the end effector 10, as best shown in FIG. 2. The main insert 40 may include an insert neck 42 extending down into the neck bore 36 and a portion of the central bore 24 of the tip 20. The axial face of the insert neck 42 of the main insert 40 may be configured to engage a rivet 12 at the distal end 12*c* thereof, as best shown in FIG. 2. A portion of the axial face of the insert neck 42 of the main insert 40 may also engage the second ledge 26*b*. A shell 43 may be configured to provide a buffer between a portion of the exterior of the main insert 40 and the bore contour 36*b*. The cap shell 43 may be formed of an elastomeric polymer or other suitable material with suitable material characteristics for the specific application of the end effector 10.

An intermediate insert 40*a* may be engaged with the main insert 40. The main insert 40 may be formed with a cup 46 near the center thereof opposite the axial surface adjacent the insert neck 42 of the main insert 40. A cup wall 46*a* may extend upward around the periphery of the cup 46. The intermediate insert 40*a* may be formed with an insert neck 42 that seats within the cup 46 of the main insert 40, as best shown in FIG. 2. The intermediate insert 40*a* may also include a cup 46 and cup wall 46*a*.

An end insert 40*b* may be engaged with an intermediate insert 40*a* or main insert 40. The end insert 40*b* may also be configured with an insert neck 42 that seats within the cup 46 of the intermediate insert 40*a* or main insert 40. The axial face of the end insert 40*b* opposite the main insert 40 may be formed with an end section seat 38*a* thereon, as described in detail above for the end section 38. In the illustrative embodiments of the end effector 10, each intermediate insert 40*a* may correspond to a housing section 37, and the end insert 40*b* may correspond to an end section 38.

Figure 9:
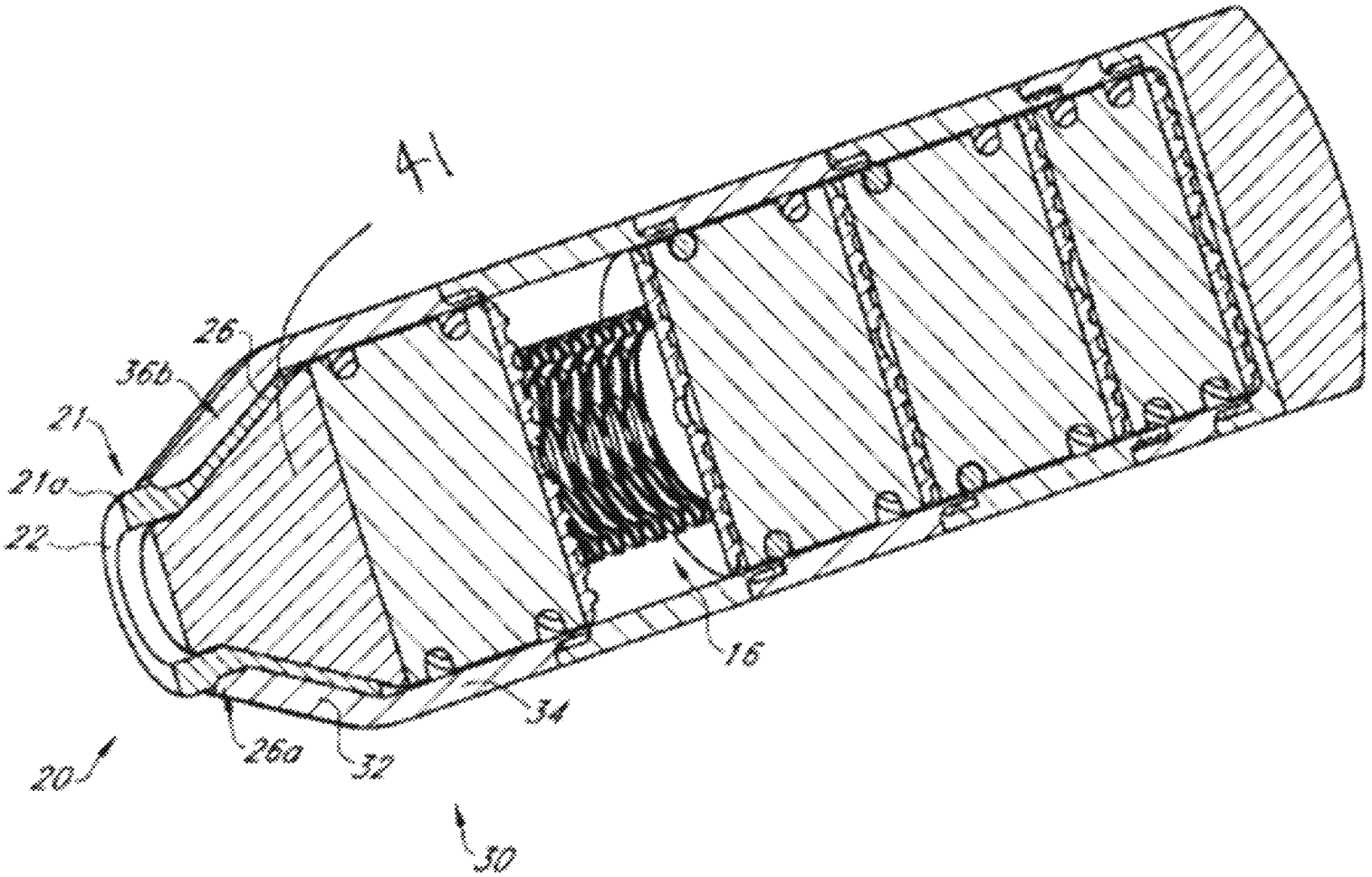
FIG. 9 provides a perspective view of another variation of the fourth embodiment of the end effector in accordance with the present disclosure wherein the contact insert is solid.

Each insert 40, 40*a*, 40*b* may be formed with an annular groove 44 therein. The annular groove 44 may cooperate with an annular ring 35 formed in the corresponding housing section 37, end section 38, and/or housing neck 30. These corresponding annular grooves 44 and annular rings 35 may serve to prevent binding between the relevant inserts 40, 40*a*, 40*b* and housing section 37, end section 38, and/or housing neck 30 during use of the end effector 10. As best shown by the illustrative figures included herein, each insert may be configured with a specific shape relative to its position in the housing (FIG. 2 main insert 40, intermediate 40*a*) or may be configured with a more generic, interchangeable shape (FIG. 9 insert 40).

The interaction and configuration between the fitting 26 and the bore shelf 36*a*, the configuration of the tip 20, and the length of the insert neck 42 may dictate the depth of the locator 28. The optimal dimensions of the locator 28 (i.e., the diameter of the central bore 24 along its length between the work piece contact surface 22 and the axial face of the insert neck 42) will vary from one application of the end effector 10 to the next, depending at least upon the size of the rivet 12, work piece material, and desired size of the resultant nugget. As stated above, it is contemplated that different tips 20 may be interchangeably used on a single end effector 10.

Figure 4A:
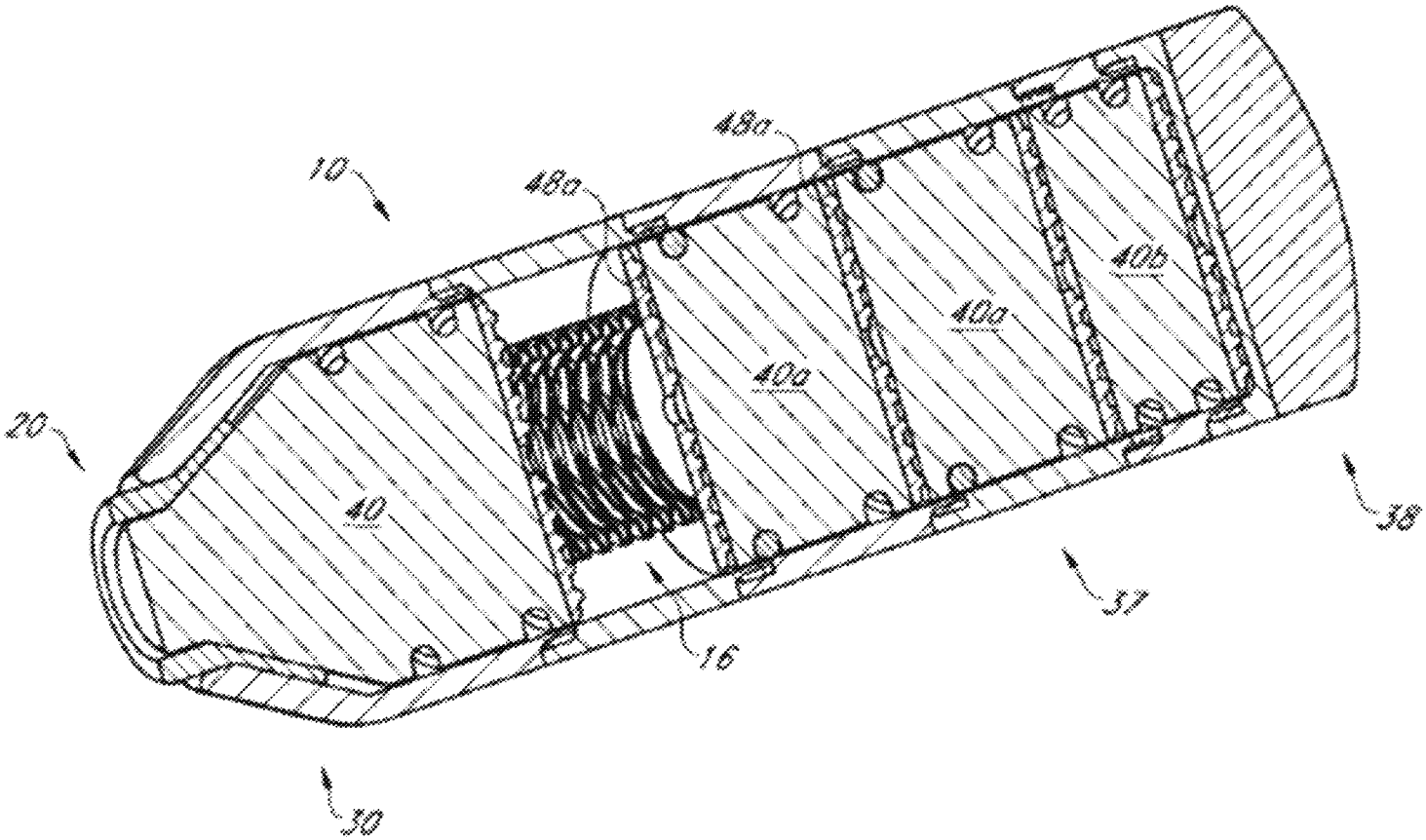
FIG. 4A provides a side, cross-sectional view of the second embodiment of an end effector in accordance with the present disclosure.
Figure 4B:
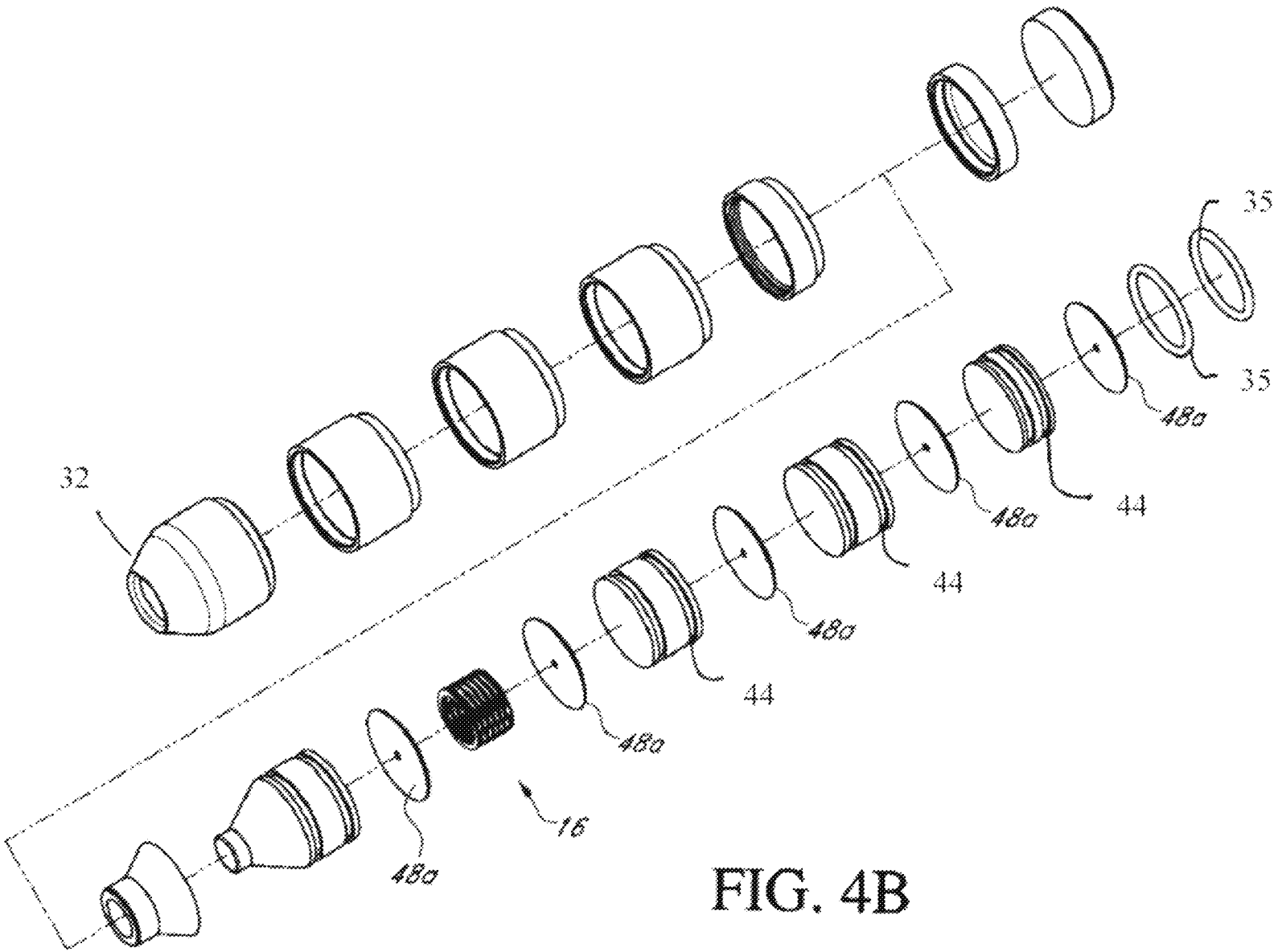
FIG. 4B provides a perspective, exploded view of the second embodiment of an end effector in accordance with the present disclosure.

A second illustrative embodiment of an end effector 10 is shown in axial cross-section in FIG. 4A and in an exploded, perspective view in FIG. 4B. The second illustrative embodiment of the end effector 10 may be configured and may function similarly to the first illustrative embodiment thereof as previously disclosed herein. The second illustrative embodiment of an end effector 10 may include a housing neck 30 and one or more housing sections 37 positioned between an end section 38, as previously described for the first illustrative embodiment of an end effector 10.

In any embodiment of an end effector 10, a biasing member 16 (such as a spring) may be encapsulated in the section seat 38*a*, insert section seat 48*a*, and/or other components. Alternatively, the end section seat 38*a*, insert section seat, and/or shell 43 could be formed as a wave spring or other energy absorbing and/or vibration damping structure. Specifically, in the second illustrative embodiment of an end effector 10, a biasing member 16 may be positioned between a main insert 40 and an intermediate insert 40*a*. However, as previously described, the biasing member 16 may be positioned at any place in the end effector 10 that will be advantageous for the specific application of the end effector 10.

An insert section seat 48*a* may be positioned between adjacent inserts 40, 40*a*, 40*b* as shown in FIGS. 4A & 4B. Additionally, insert section seats 48*a* may be positioned on an axial surface of an insert 40, 40*a*, 40*b* that engages the biasing member 16. In a manner similar to that described above for the end section seat 38*a*, an insert section seat 48*a* may be formed of an elastomeric polymer or other suitable material with suitable material characteristics for the specific application of the end effector 10.

Figure 5:
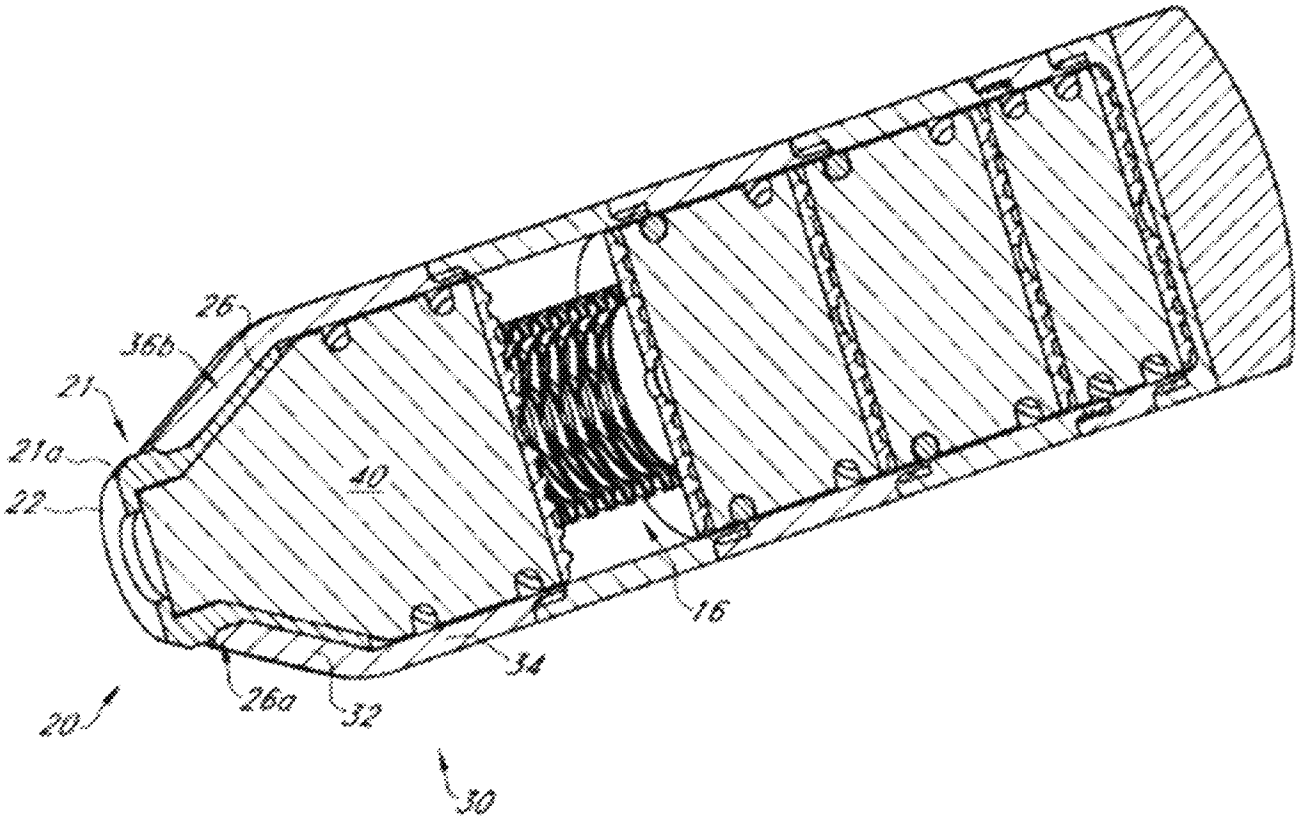
FIG. 5 provides a side, cross-sectional view of a third embodiment of an end effector in accordance with the present disclosure.

A third illustrative embodiment of an end effector 10 is shown in cross-section in FIG. 5. The third illustrative embodiment of an end effector 10 is similar to the second embodiment thereof (shown in FIGS. 4A & 4B), and those two illustrative embodiments generally function in the same manner. However, in the third illustrative embodiment, the tip 20 may be formed with a ridge 21 located between the work piece contact surface 22 and the ledge 26*a*. The ridge 21 may be formed with a ramp 21*a* on the distal edge thereof, as shown in FIG. 5.

The tip 20 in the third illustrative embodiment of an end effector 10 may be configured to facilitate engaging the tip 20 with the housing neck 30 via a snap-together arrangement. For example, the tip 20 may be positioned inside the housing neck 30 prior to assembly of the end effector 10. The tip 20 may be pressed toward the distal end of the housing neck 30 (i.e., in a direction from the neck second portion 34 toward the neck first portion 32 along the longitudinal axis of the housing neck 30). As this relative movement between the tip 20 and the housing neck 30 occurs, the ramp 21*a* formed on the leading edge of the ridge 21 encounters the interior surface of the housing neck 30 until the ridge 21 eventually passes through the neck bore 36 and emerges external to the neck housing 30. The bore contour 36*b* of the housing neck 30 and the fitting 26 of the tip 20 may be cooperatively frustum shaped, such that the fitting 26 seats within the bore contour 36*b*. A ledge 26*a* formed in the trailing edge of the ridge 21 may interface with an axial exterior face of the housing neck 30 to ensure that the tip 20 does not move relative to the housing neck in a direction away from the work piece contact surface 22 and toward the end section 38. From the present disclosure, those of ordinary skill in the art will appreciate that in any embodiment of the end effector 10, the tip 20 and housing neck 30 may be configured to cooperatively engage one another such that relative motion therebetween is allowed in certain circumstances (i.e., when assembling the end effector 10 and inserting the tip 20 through the housing neck 30), but not allowed in other circumstances (i.e., after the ramp 21 has passed through the neck bore 36 such that the ledge 26*a* engages an axial exterior face of the housing neck 30).

Figure 6:
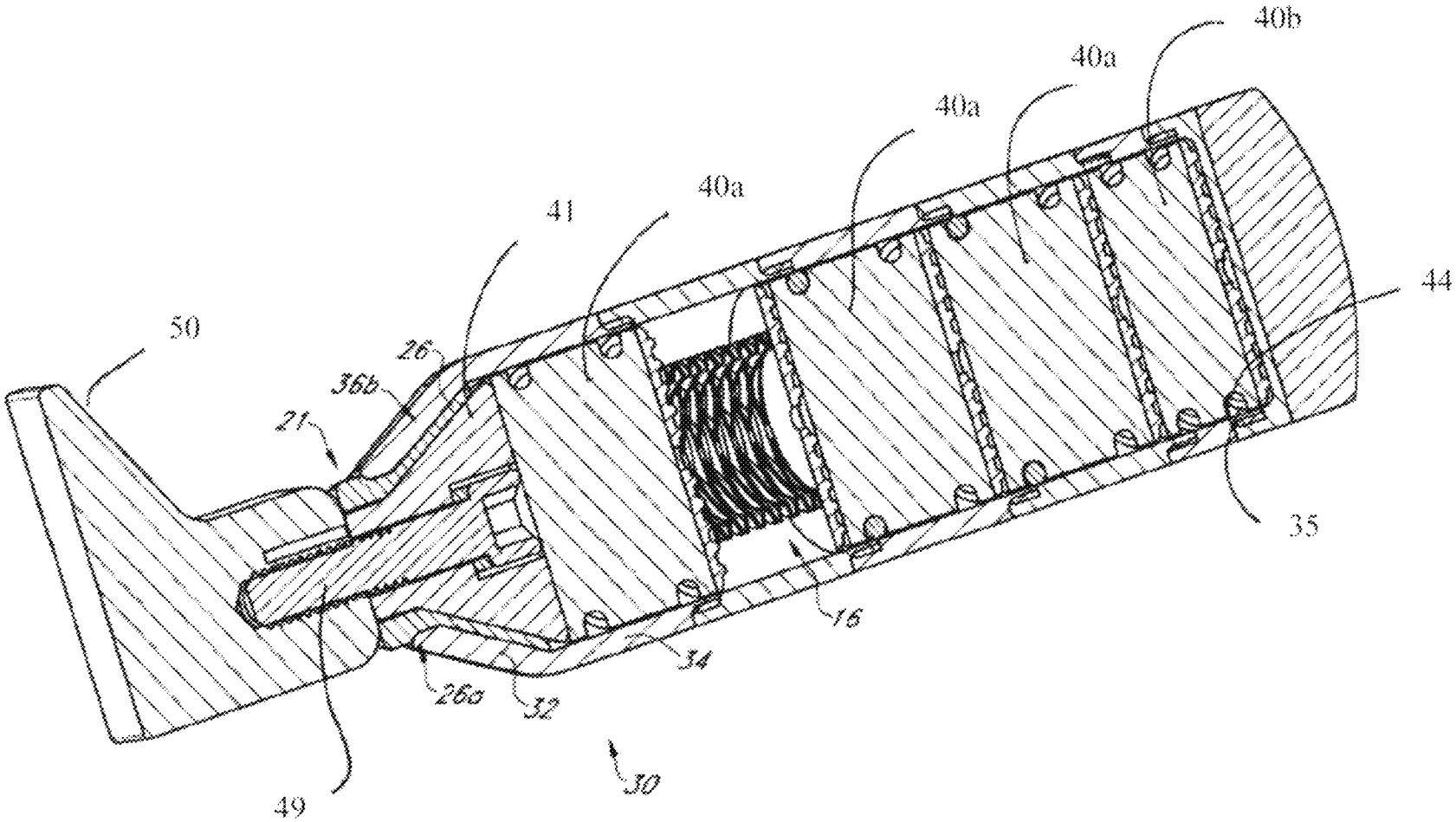
FIG. 6 provides a side, cross-sectional view of a fourth embodiment of an end effector in accordance with the present disclosure.
Figure 7:
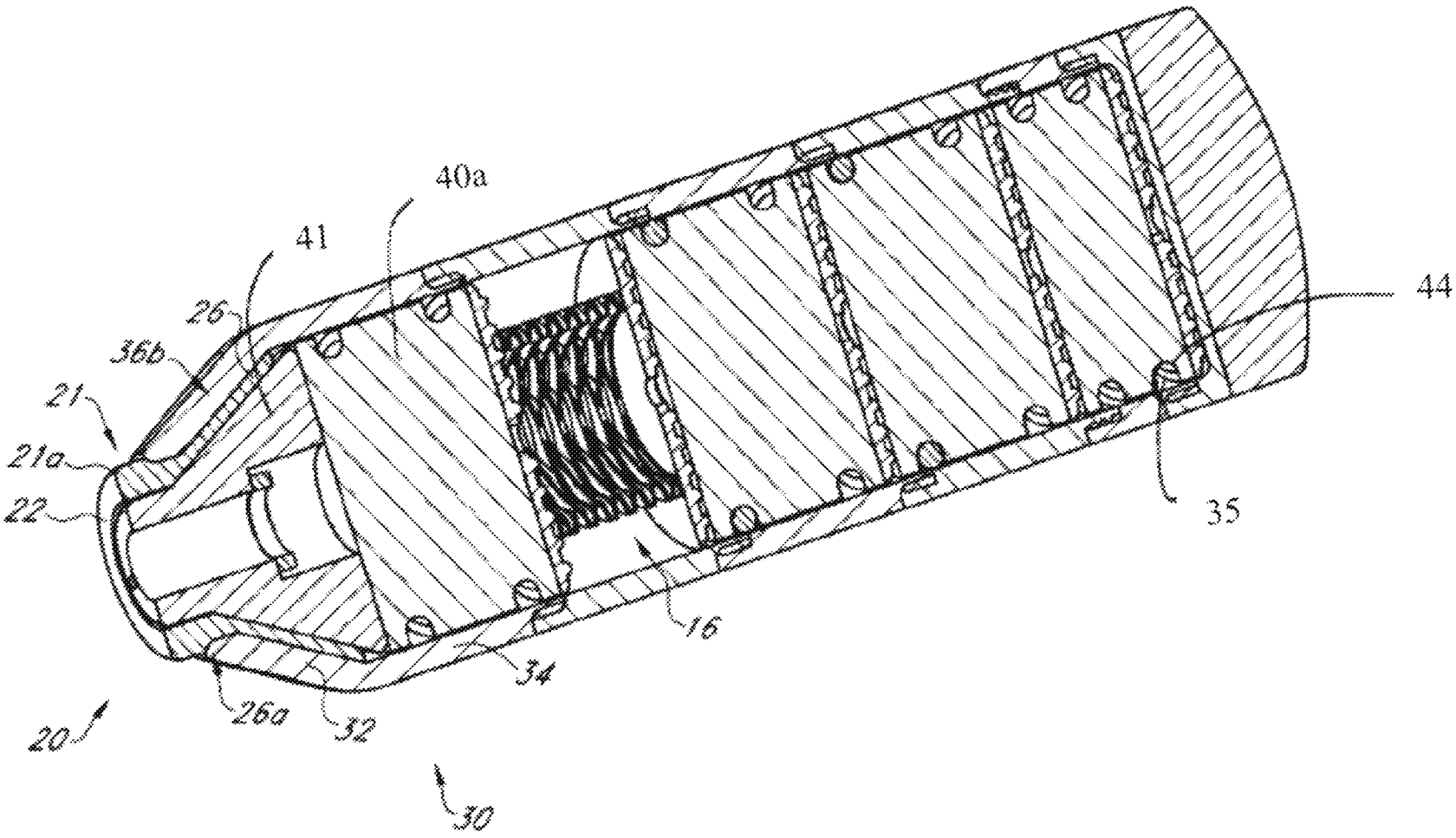
FIG. 7 provides a side, cross-sectional view of embodiment of FIG. 6 with the attachment bolt and dolly (foot) removed to better highlight the conical contact insert.
Figure 8:
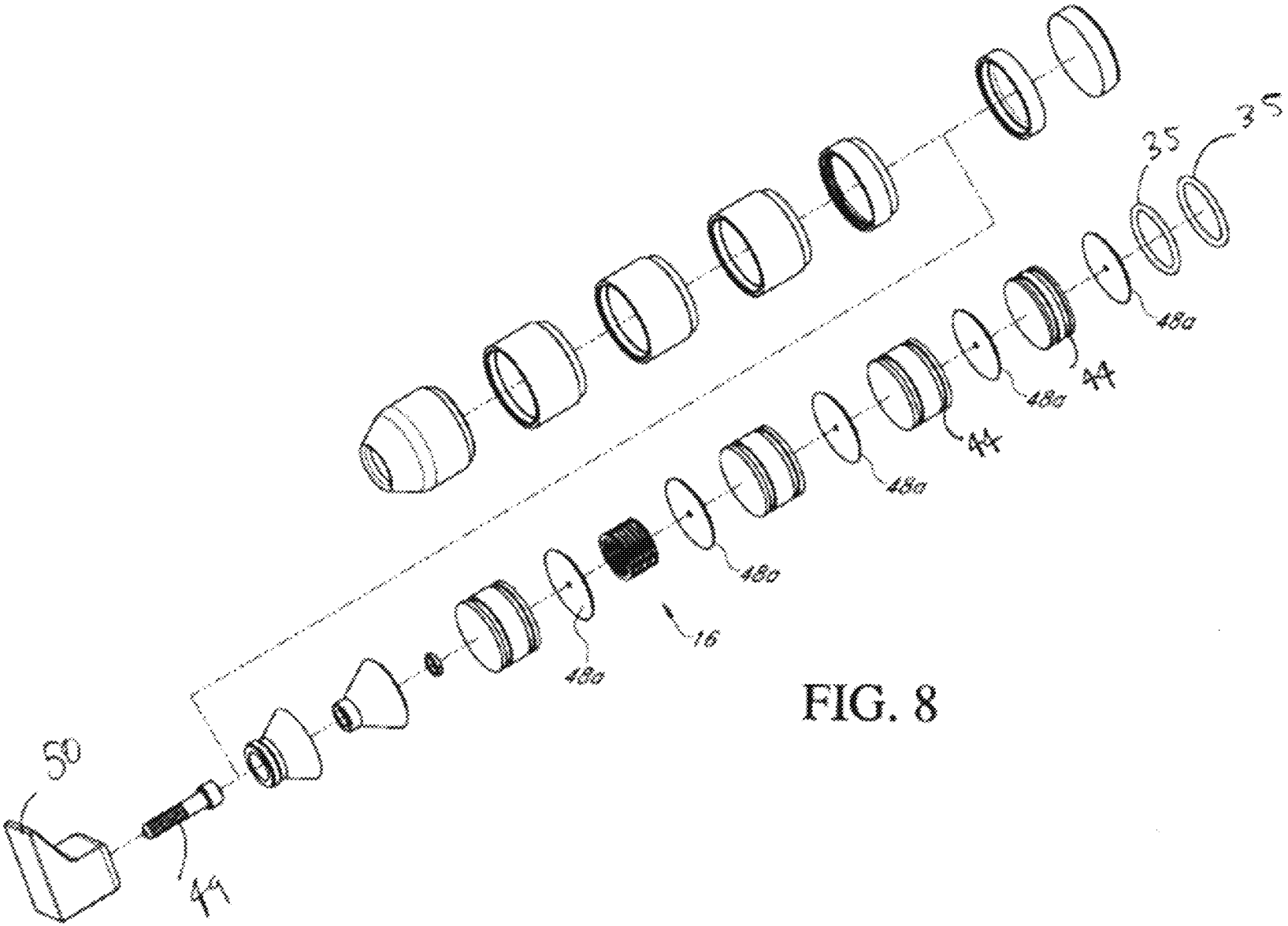
FIG. 8 provides a perspective, exploded view of the fourth embodiment of an end effector in accordance with the present disclosure.

FIG. 6 provides a side, cross-sectional view of a fourth embodiment of end effector 10. FIG. 7 provides a side, cross-sectional view of embodiment of FIG. 6 with the attachment bolt 49 and dolly (foot) 50 removed to better highlight the contact insert 41. As shown, contact insert may be configured with a bore 51. FIG. 8 provides a perspective, exploded view of the fourth embodiment of an end effector 10 in accordance with the present disclosure. As will be apparent, main insert 40 has been replaced with the contact insert 41, which has been configured to fit in the housing neck 30. The contact insert 41 has been configured to allow a threads and insertion of a bolt 49. The dolly 50 attached to the end of the bolt 49 is an exemplary embodiment of a work piece contact surface 22 allowed by the interchangeability or removable/replacement of the tip 20. As shown in FIGS. 6-8, replacement of main insert 40 with contact insert 41 allows the remaining inserts (40*a*, 40*b*) positioned in the housing to be of similar shape and size to allow interchangeability, if desired.

Further, FIG. 9 provides a perspective view of another variation of the fourth embodiment of the end effector 10 wherein the contact insert 41 is solid. As shown in FIG. 9, solid contact insert 41 is shown having a blunt nose and is fabricated from a durable material, such as steel, without limitation, to provide durability from direct and repeated engagement with the distal end of a rivet 12, for example. One of ordinary skill will appreciate that the length of the contact insert 41 may be lengthened or shortened to allow more or less engagement with more or less fastener or rivet. As discussed previously, and by way of illustration and without limitation, allows for interchangeable tip 20, with work piece contact surface 22, configured with the ridge 21 and ramp 21*a*, for engagement with ledge 26*a* and second ledge 26*b* of the interior of housing to removably lock the fitting 26 into the housing neck 30 to produce an ergonomic end effector 10 that via locator 28 aids in superior effectuation of the fastener, or production of the nugget if a rivet is acted upon. Further, variation in the size of the central bore and variation in the length of the tip 20, allows variation of the size of the contact insert 41 which allows for engagement with different fastener and rivet lengths as well as diameters, as desired, from a common end effector 10.

Figure 10:
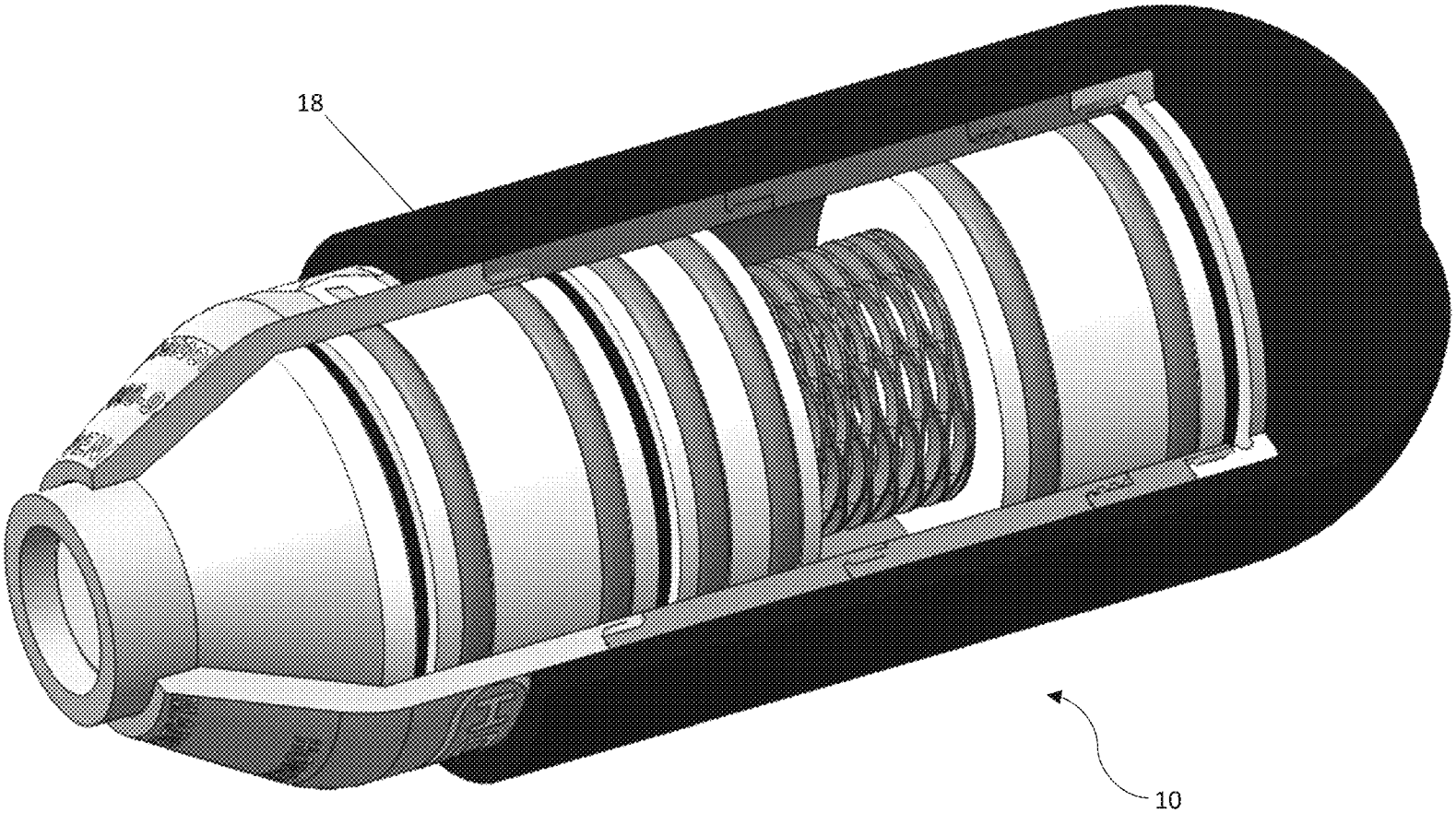
FIG. 10 provides a perspective, cutaway view of another embodiment of an end effector.

Another embodiment of an end effector 10 is shown in FIG. 10, wherein a portion of the housing sections 37 have been removed to show a portion of the interior of the end effector 10. Generally, this embodiment of an end effector 10 may be configured similar to those shown previously in FIGS. 1-5 & 9, wherein the end effector 10 may be configured in a modular manner for specific applications and provide some or all of the various benefits thereof without limitation unless otherwise indicated in the following claims.

Additionally, in the embodiment shown in FIG. 10 a sleeve 18 may be positioned over a portion of the exterior of the end effector 10. It is contemplated that the sleeve 18 may be positioned on the exterior of the end effector 10 such that during use, a user engages the end effector 10 primarily at the sleeve 18. The sleeve 18 may be constructed of any suitable material including but not limited to shock- and/or energy-absorbing elastomers (such as polyurethane, polyether eurethane, and/or other polymers), vibration dampening material, natural materials, and/or combinations thereof. The sleeve 18 may serve to reduce noise during use, vibrations transferred to the user, and/or forces transferred to the user without limitation unless otherwise indicated in the following claims. The sleeve 18 may be removed for access to a housing section 37, end section 38, the cap 39, and/or other portions of the end effector 10, after which the sleeve 18 may be re-engaged with a portion of the exterior of the end effector 10.

The sleeve 18 may be formed with various contours and/or ridges to aide a user's grip of the end effector 10, to reduce user fatigue during use of the end effector 18, and/or to increase comfort and/or ergonomic efficiency of the end effector without limitation unless otherwise indicated in the following claims.

From the foregoing description, one of ordinary skill in the art will understand that the illustrative embodiments of the end effector 10 as disclosed herein are designed to be modular. That is, the user may determine the number of housing sections 37 and corresponding intermediate inserts 40*a*, which may range from zero to as many as needed for a specific application. The number of intermediate inserts 40*a* and housing sections 37 will affect at least the mass of the end effector 10, thereby allowing the user to adjust the physical characteristics of the end effector 10 for optimizing performance for different applications. That is, if more resistance is needed on the distal end 12*c* of the rivet 12, the user may increase the mass of the end effector 10 by adding intermediate inserts 40*a* and housing sections 37. Accordingly, the specific mass of any insert 40, 40*a*, 40*b* and/or housing section 37, end section 38, and/or housing neck 30 in no way limits the scope of the end effector 10 as disclosed and claimed herein.

During use, it is contemplated that the end effector 10 will provide a user a more ergonomic and comfortable experience, requiring less effort from the user resulting in a less fatigue during use as compared to the prior art. Additionally, the illustrative embodiments of the end effector 10 may be adjusted for optimal use in an infinite number of applications. Additionally, the locator 28 ensures that the user properly locates the distal end 12*c* of the rivet 12 and creates a uniform nugget as the distal end 12*c* is spread.

During use, forces imparted to the rivet 12 may be transferred to the end effector 10 through the main insert 40. Those forces may travel up the main insert 40 to any intermediate inserts 40*a* and/or end insert 40*b*. Additionally, the annular grooves 44 and annular rings 35 may communicate a portion of these forces to the housing neck 30, housing sections 37, and/or end section 38. A portion of those forces may also be communicated to the housing neck 30, housing sections 37, and/or end section 38 via the interaction between an end section seat 38*a* on either the end insert 40*b* and/or end section 38. The end section seat 38*a*, annular ring(s) 35, cap 39, and/or shell 43 may serve to reduce noise during use, vibrations transferred to the user, and/or forces transferred to the user.

The optimal dimensions and/or configuration of the tip 20, hosing neck, housing section 37, end section, and/or inserts 40, 40*a*, 40*b* will vary from one embodiment of the end effector 10 to the next, and are therefore in no way limiting to the scope thereof. These elements may be formed of any material that is suitable for the application for which the end effector 10 is used. Such materials include but are not limited to metals and their metal alloys, polymeric materials, and/or combinations thereof.

ILLUSTRATIVE EMBODIMENTS OF A JACKET

Figure 12A:
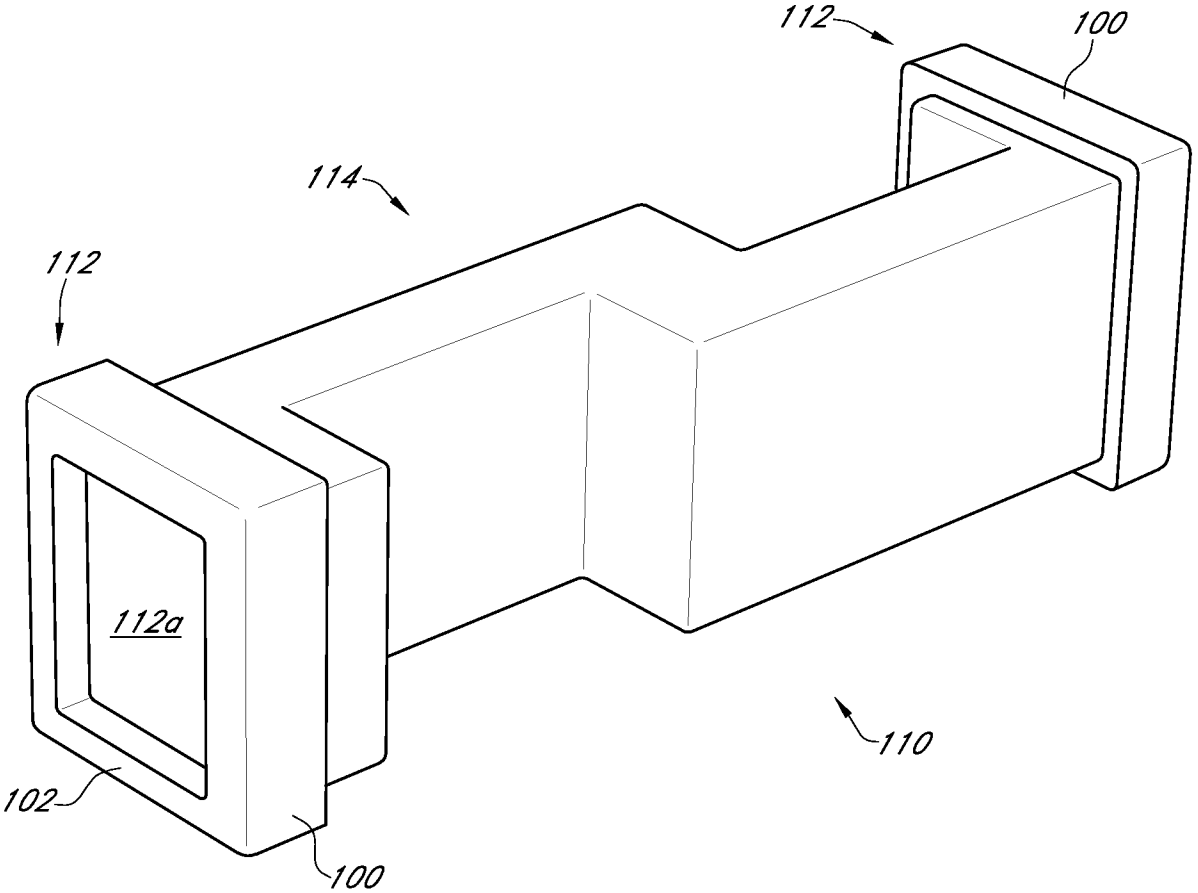
FIG. 12A [was 10] provides a perspective view of another illustrative embodiment of an end effector having an illustrative embodiment of a jacket engaged with each end of the end effector.
Figure 12B:
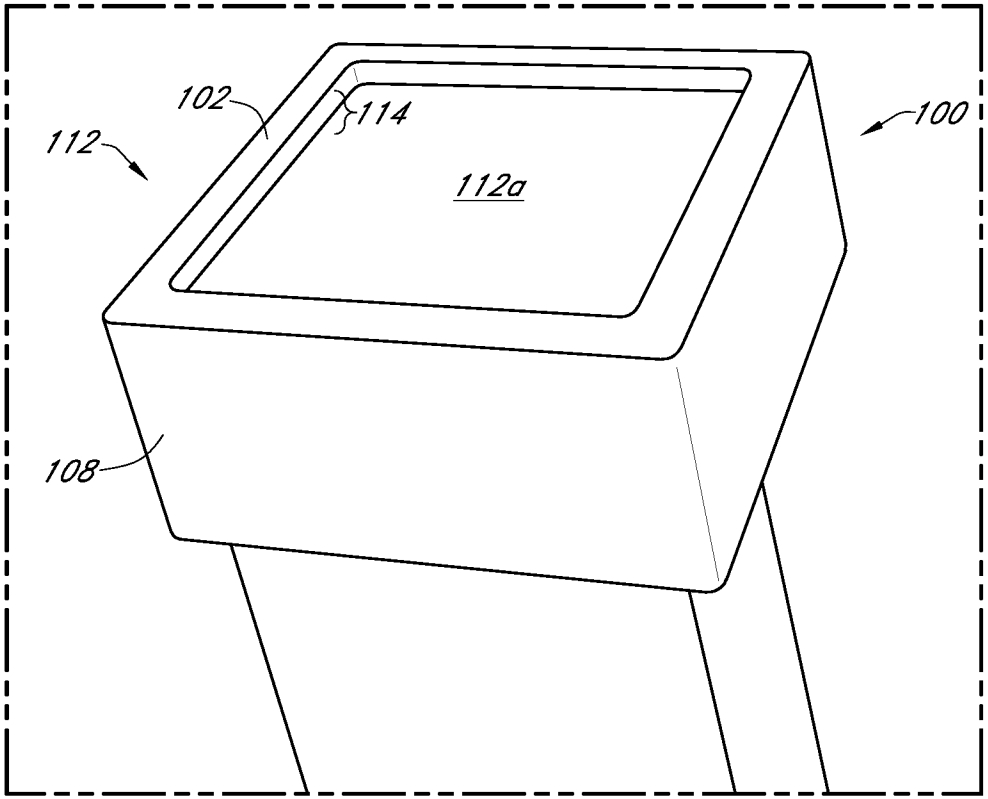
FIG. 12B [was 11] provides a detailed perspective view of the contact end of the end effector of FIG. 12A.
Figure 12C:
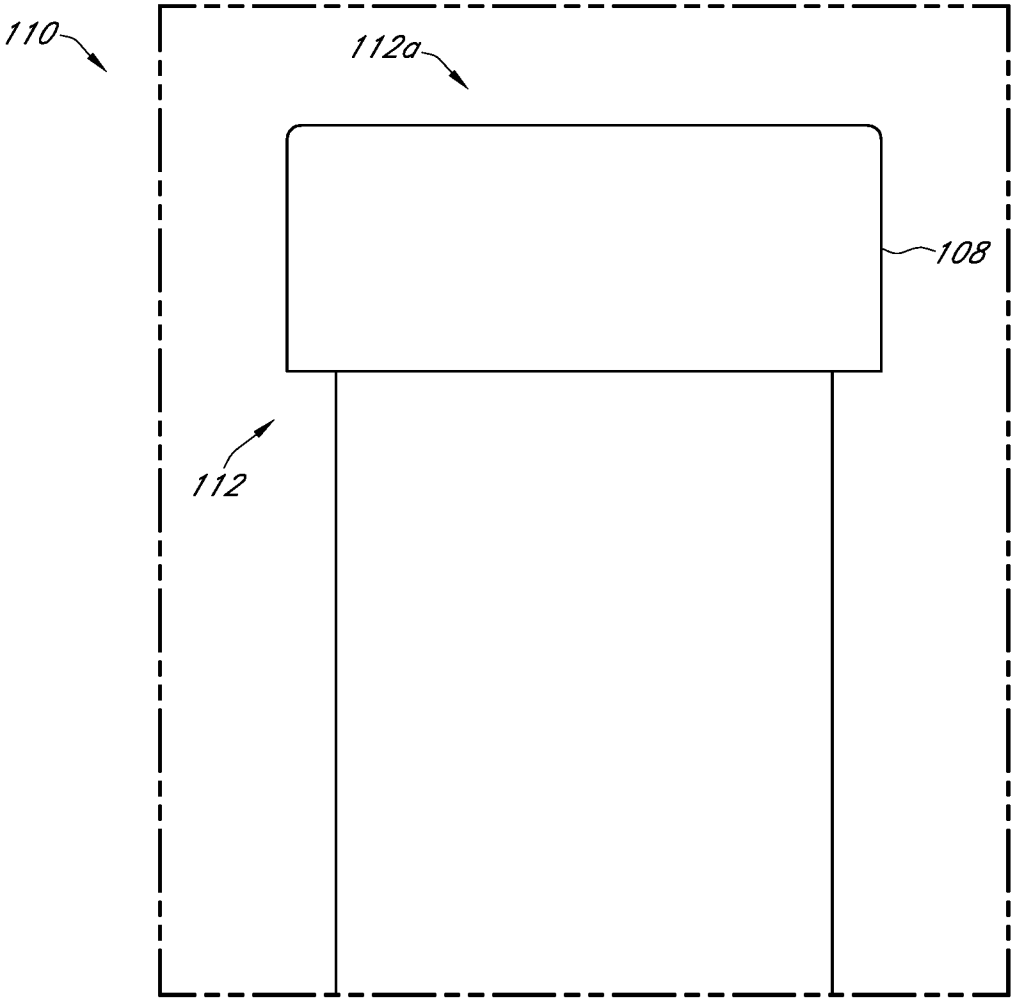
FIG. 12C provides a side view side view of the end effector shown in FIGS. 12A & 12B.
Figure 12D:
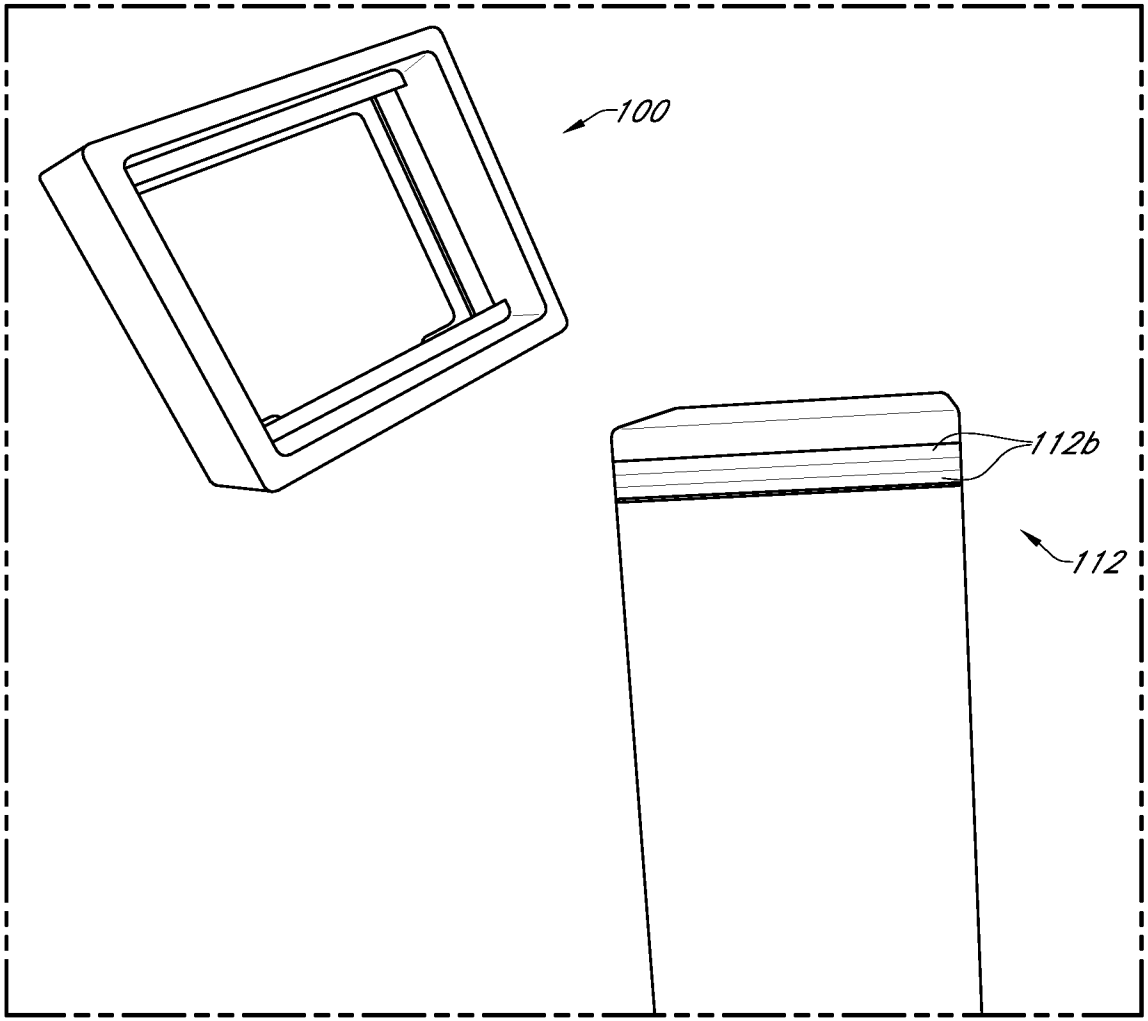
FIG. 12D provides a perspective view of the end effector and jacket from FIGS. 12A-12C disassembled.
Figure 13:
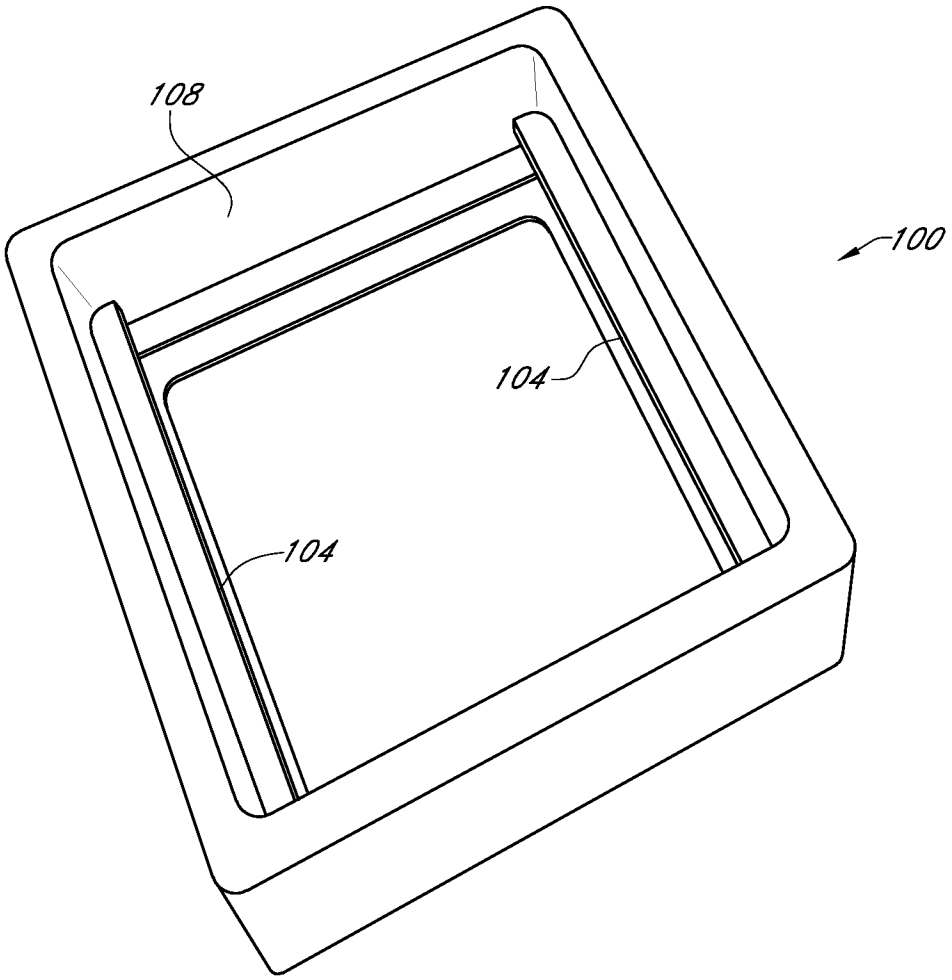
FIG. 13 is a detailed perspective view of the interior of the illustrative embodiment of a jacket shown in FIGS. 12A-12D.

Referring now to FIGS. 12A-13, a first illustrative embodiment of a jacket 100 that may be used with various embodiments of an end effector 110 are shown therein. Generally, the illustrative embodiment of a jacket 100 may be configured for use with end effectors from the prior art as well as end effectors 10', 110 according to the present disclosure without limitation unless otherwise indicated in the following claims.

Figure 11:
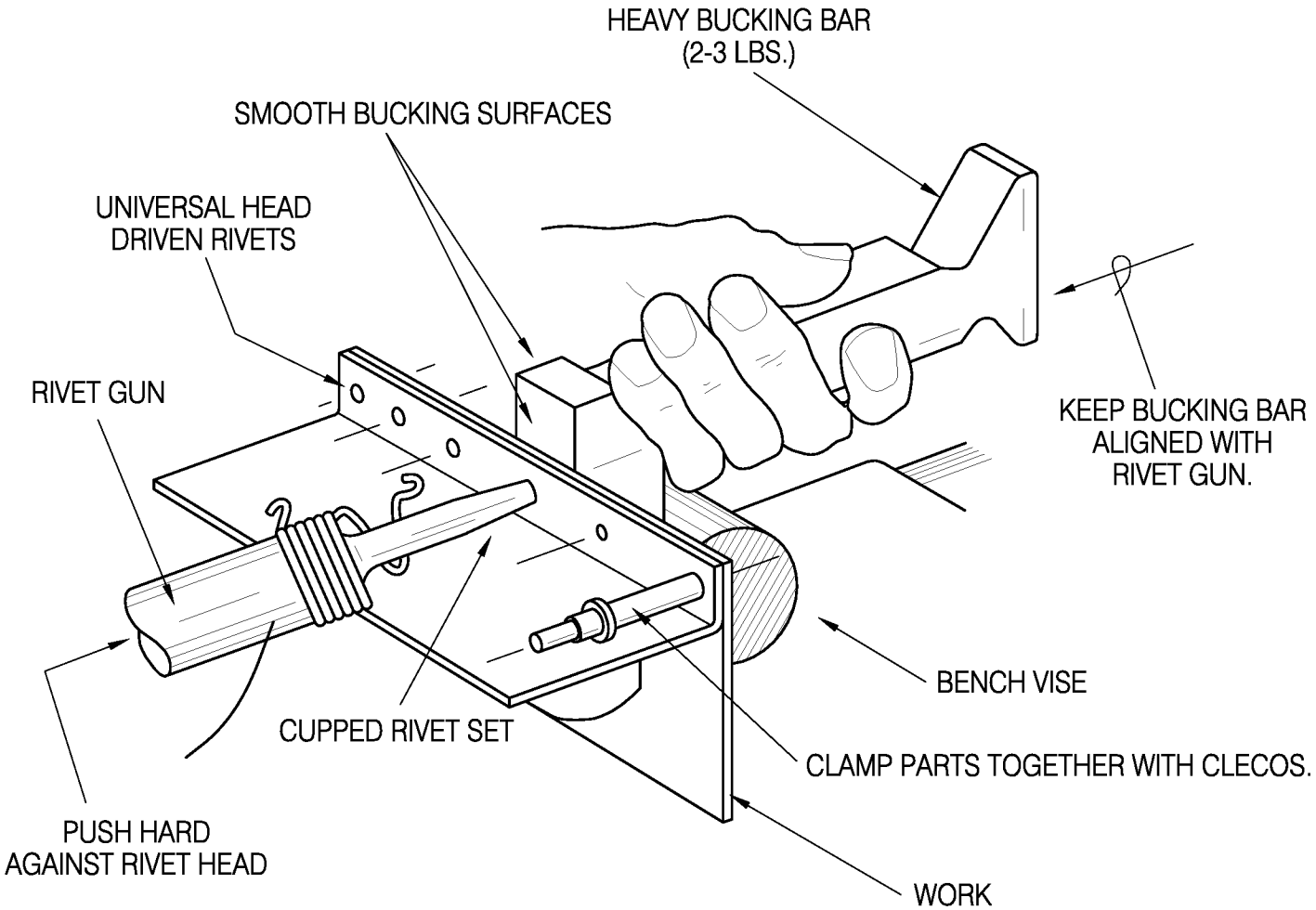
FIG. 11 (PRIOR ART)
FIG. 11 [was 17] provides a perspective view depicting installation of a rivet as known in the prior art using a prior art end effector (bucking bar).

A prior art end effector (sometimes referred to by those of ordinary skill in the art and therein as a "bucking bar") in use for one specific application thereof is shown in FIG. 11, which is included herewith for reference regarding rivets and methods for riveting. As shown in FIG. 11, corresponding holes in two work pieces may be aligned such that a rivet distal end 12*c* (or "tail") may be inserted through the two aligned and corresponding holes. The head 12*b* of the rivet 12 may be sized and shaped such that it is retained on one side of the holes. At this point, a rivet gun or pneumatic hammer may be applied to the head 12*b* of the rivet 12 with a bucking bar applied to the distal end 12*c* of the rivet 12 and a nugget/bucktail may be formed by deforming the distal end 12*c* of the rivet 12 into a nugget/bucktail.

In one application, using the jacket 100 on an end effector 110 may to reduce or eliminate "over bucking" or "overdriving" rivets during installation. Overdriving rivets may produce micro-fracturing in the installed rivet, thereby reducing the strength of the rivet, which may lead to premature failure and/or deterioration of the rivet. Further, overdriving rivets may damage or mar the surface of the work piece (e.g., wing, flap, body, joint, panel, etc.) surrounding or adjacent to the rivet during installation, which can lead to premature failure and/or deterioration of the work piece. Generally, as used herein "work piece" may be used to denote any structure with which a rivet may be engaged.

It is contemplated that reducing or eliminating the possibility of a user overdriving a rivet would be an advantage and a benefit as it may prolong the life of both the rivet and the work piece(s) with which the rivet is engaged. It is further contemplated that this may be of particular importance in protecting the skin of the airplane, its flaps, sidewalls, wings, body, etc., as these rivets may be used to attach, fasten, secure, engage, and/or otherwise be implemented in conjunction with such elements. As the materials used in the construction of modern airplanes are ever more exotic, including by way of example but without limitation or restriction unless otherwise indicated in the following claims, carbon fiber-based materials for the work piece (skins) and titanium-based materials for the rivets, such that there is a need for improvements in installation methods and tools.

An end effector 110 with the first illustrative embodiment of a jacket 100 engaged with each work end 112 of the end effector 110 is shown in perspective in FIG. 12A. The end effector 110 may be formed with a grip portion 114 positioned between two work ends 112. A detailed perspective view of the work end 112 is shown in FIG. 12B, and a side view thereof is shown in FIG. 12C. The jacket 100 may be configured such that the shape of its periphery matches or nearly matches the shape of the periphery of the work end 112 of the end effector 110. The jacket 100 may be formed with one or more jacket sides 108 extending over a portion of the work end 112. Although the first illustrative embodiment of a jacket 100 is shown as a rectangle (and specifically as being square-shaped and having four equal jacket sides 108), in other applications the optimal configuration may be of different shapes (e.g., rectangular, circular, curved, triangular, etc.) and the jacket sides 108 may be differently configured without limitation unless otherwise indicated in the following claims.

Generally, it is contemplated that the work end face 112*a* may be in contact with the rivet tail during use, such that contact between the work end face 112*a* and rivet tail causes the rivet tail to deform into a rivet nugget (or bucktail) during driving of the rivet. Referring specifically to FIG. 12B, a portion of the jacket 100 may be parallel to but raised above the work end face 112*a*, which portion is the work piece contact surface 102 of the jacket 100. It is contemplated that at least a portion of the work piece contact surface 102 may be in direct contact with the work piece during rivet installation. In the embodiment of a jacket 100 shown in FIGS. 12A-13, the work piece contact surface 102 may be positioned around the entire periphery of the jacket 100 (e.g., all four sides of the work end face 112*a*). However, other illustrative embodiments of the jacket 100 may have differently configured work piece contact surfaces 102 without limitation unless otherwise indicated in the following claims, such as other illustrative embodiments of the jacket 100 as described in detail below.

The distance between the work end face 112*a* and work piece contact surface 102 is the jacket height limit 106. The optimal jacket height limit 106 may be, by illustration, from 0.01 inches to 0.175 inches without limitation unless otherwise indicated in the following claims. In other applications the jacket height limit 106 may be greater than 0.175 inches. Generally, the optimal jacket height limit 106 may depend at least on the diameter and composition of the rivet. By way of illustration and without limitation unless otherwise indicated in the following claims, a large-diameter rivet may require a larger jacket height limit 106 to ensure appropriate space for the rivet tail to form a nugget/bucktail, whereas a smaller jacket height limit 106 may be appropriate for smaller-diameter rivets not requiring as much space for the rivet tail to spread into a nugget/bucktail. Also by way of illustration and without limitation unless otherwise indicated in the following claims, a rivet composed of a relatively hard, relatively strong/resilient material (e.g., titanium) may only require a relatively small jacket height limit 106 due to the relatively lower amount of rivet tail deformation required to make the nugget/bucktail for rivets composed of a relatively stronger, harder material. Accordingly, the optimal jacket height limit 106 may vary from one application to the next and is therefore in no way limiting to the scope of the present disclosure unless otherwise indicated in the following claims. It is contemplated that the jacket height limit 106 may dictate a minimum height of a nugget such that the height of a nugget may not be less than the jacket height limit 106, which may prevent overdriving of the rivet as discussed above.

A perspective view of the first illustrative embodiment of the jacket 100 removed from the end effector 110 is shown in FIG. 12D. An interior surface of one or more of the jacket sides 108 may be formed with a jacket ridge 104 extending inward from the interior surface of the jacket side 108 (which jacket ridge 104 is shown at least in FIGS. 12B and 13 for the first illustrative embodiment of a jacket 110), which jacket ridge 104 may be configured to selectively engage one or more work end grooves 112*b* that may be formed in the work end 112 of the end effector. The jacket 100 may also include a lip 105 around all or a portion of the periphery of the jacket 100 and extending inward therefrom such that an interior surface of the lip 105 engages the periphery of the work end face 112*a* when the jacket 100 is engaged with the work end 112. It is contemplated that such an engagement may further serve to prevent unwanted movement of the jacket 100 with respect to the work end 112 without limitation unless otherwise indicated in the following claims. A jacket ridge 104 and a corresponding end effector groove 112*b* may work together to allow the jacket 100 to fit over and onto the work end 112 of the end effector 110, thereby leaving the work end face 112*a* exposed but surrounded by the jacket 100 such that the work piece contact surface may act as a type of bumper against the work piece.

In one illustrative embodiment, the jacket ridge 104 may be configured to slide along the sides of the end effector 110 and then snap into one or more work end grooves 112*b* to lock the position of the jacket 100 with respect to the work end face 112*a* of the end effector 110. It is contemplated that in one illustrative embodiment the end effector 110 may be configured with a first set of work end grooves 112*b* at a first distance from the work end face 112*a* and a second set of work end grooves 112*b* at a second distance from the work end face 112*a* such that when a jacket ridge 104 is engaged with a first work end groove 112*b* the jacket height limit 106 is a first distance and when the jacket ridge 104 is engaged with a second work end groove 112*b* the jacket height limit 106 is a second distance. However, other configurations of the work end grooves 112*b* may be used without limitation unless otherwise indicated in the following claims.

Generally, the jacket 100 may be configured from various softer, non-metal materials, including but not limited to polymers, plastic urethane, and/or combinations thereof without limitation unless otherwise indicated in the following claims. The jacket 100, and in particular the jacket ridge 104 and work end groove 112*b* may be configured with an interference fit, wherein the jacket 100 may stretch/deform to allow insertion of end effector 110 into the jacket 100. One of ordinary skill will appreciate that although not shown, in another embodiment the jacket ridge 104 could be configured as a groove and work end groove 112*b* could be configured as a ridge without departure from the present disclosure without limitation unless otherwise indicated in the following claims.

Figure 14:
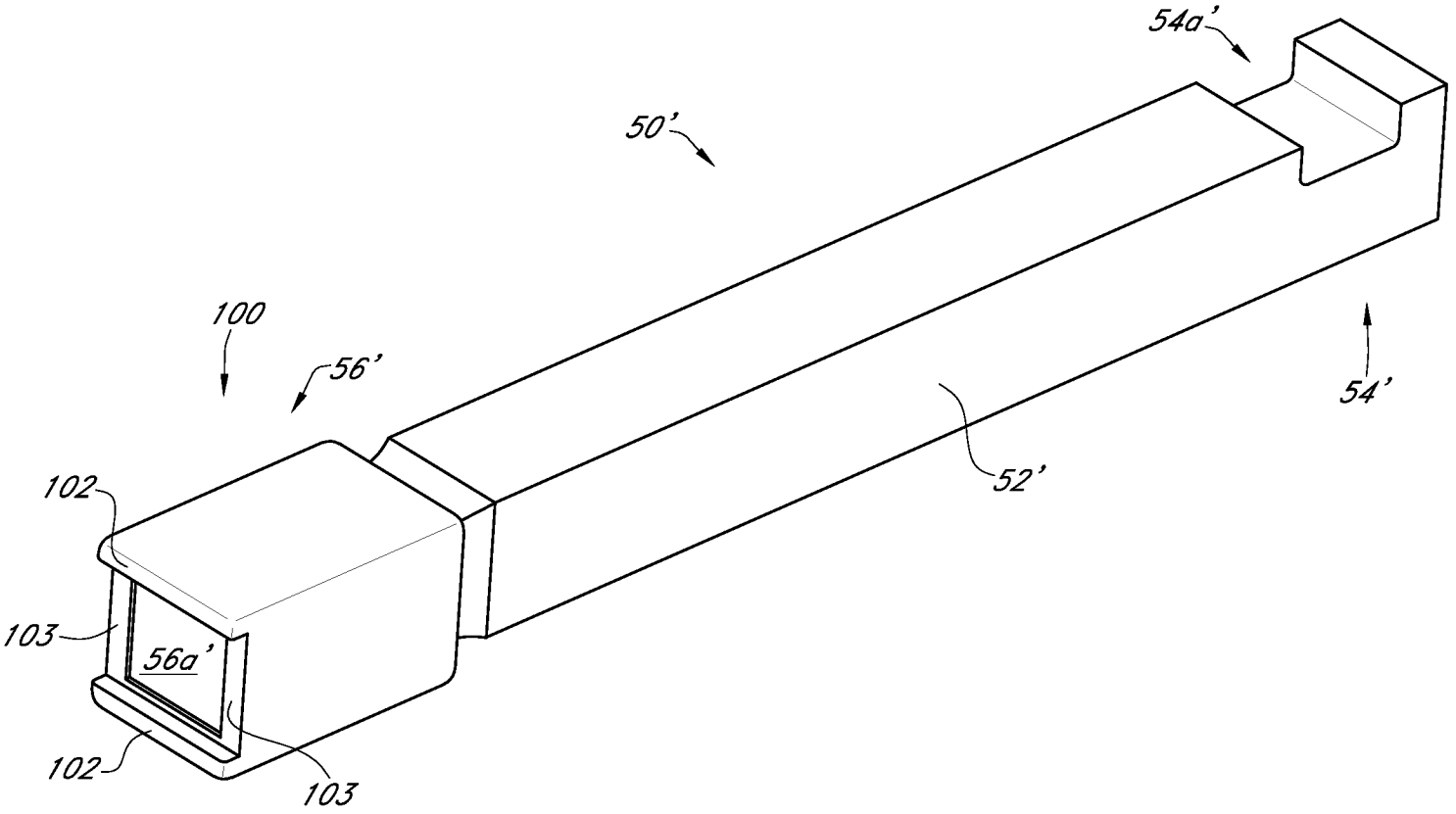
FIG. 14 is a perspective view of a dolly having another illustrative embodiment of a jacket engaged with the contact end of the dolly.
Figure 15A:
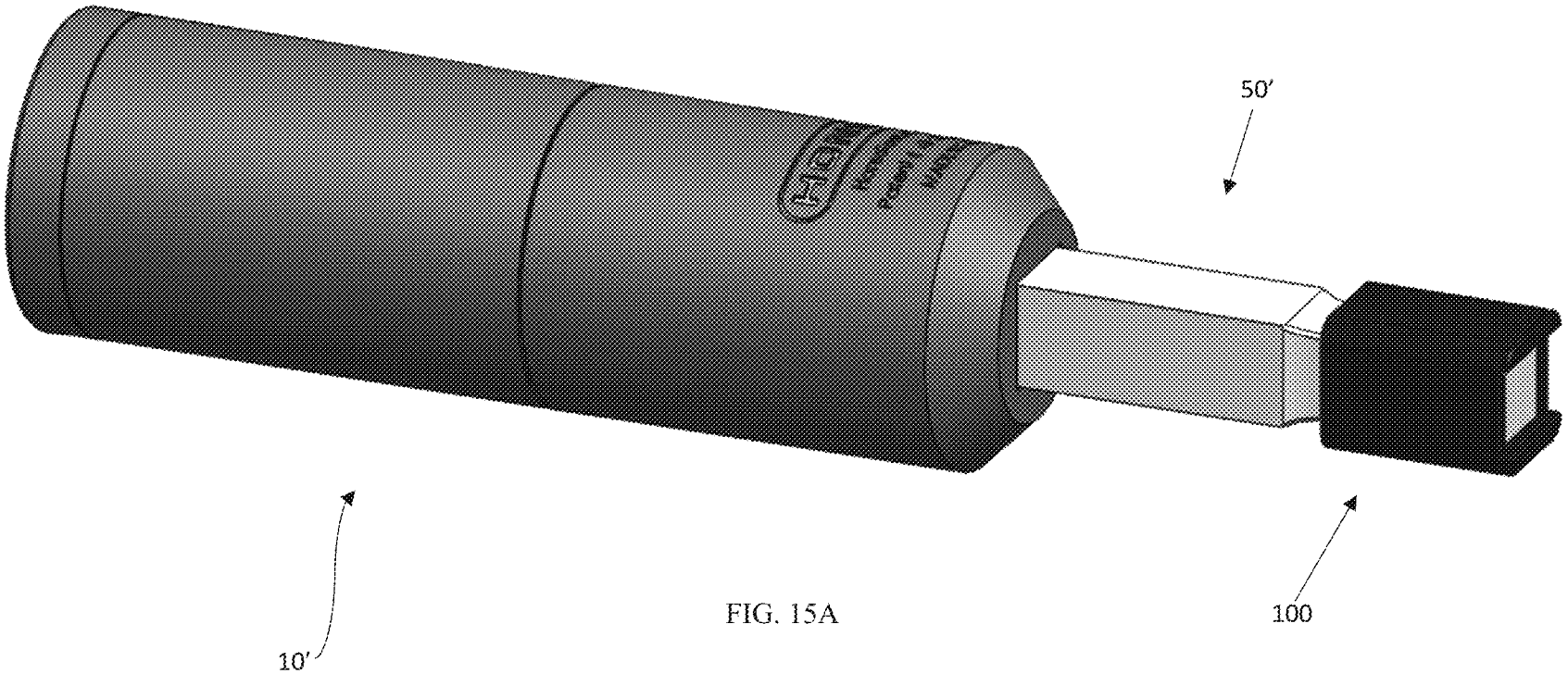
FIG. 15A is a perspective view of another illustrative embodiment of an end effector utilizing a dolly and jacket such as that shown in FIG. 14.
Figure 15B:
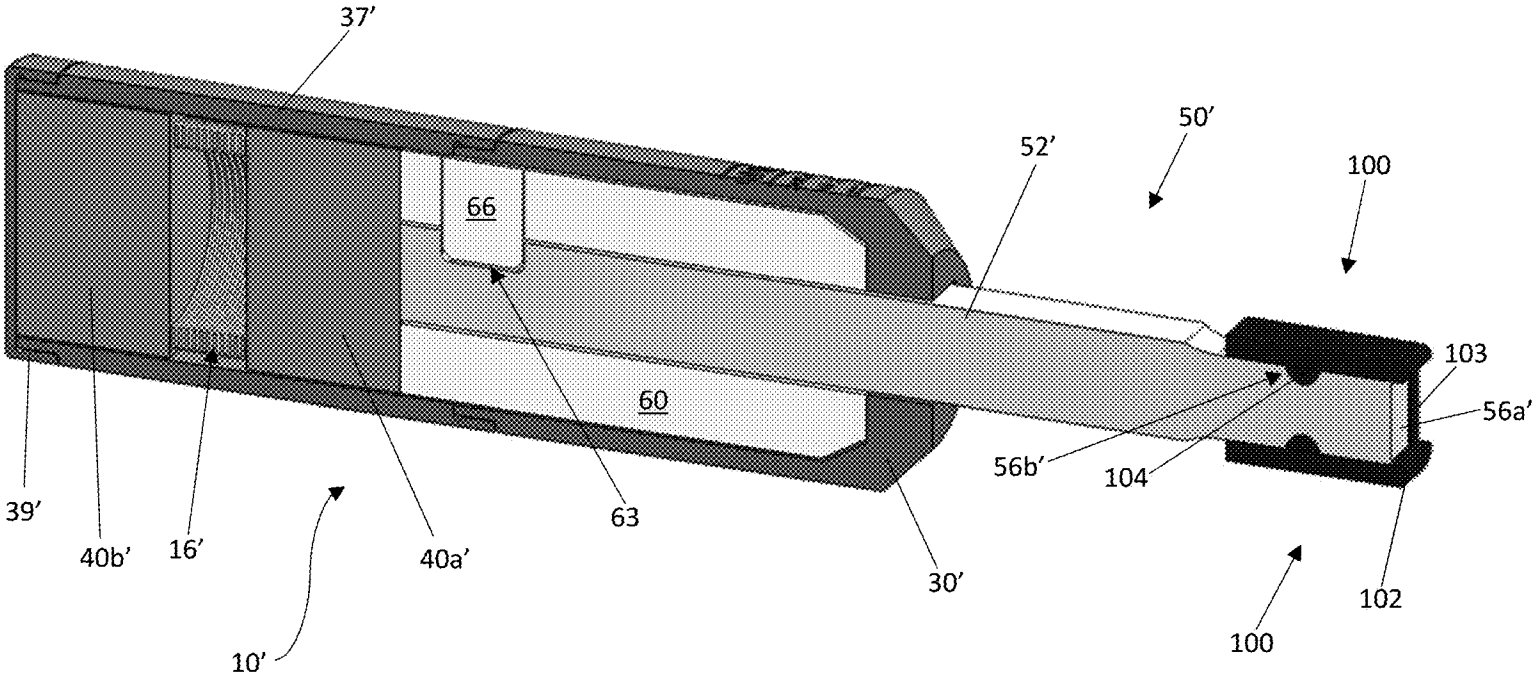
FIG. 15B is a cutaway view of the end effector shown in FIG. 15A.

Another illustrative embodiment of a jacket 100 is shown engaged with a contact end 56' of a dolly 50' in FIGS. 14, 15A, & 15B. The dolly 50' may be configured as a component of an end effector 10' such as those shown in FIGS. 15A and 15B (as well as those shown in FIGS. 16A-19C without limitation unless otherwise indicated in the following claims) and described in detail below, which end effectors 10' may provide at least the modularity of the end effectors 10 previously described. The embodiment of a jacket 100 shown in FIGS. 14, 15A, & 15B may function in a manner similar to and provide at least the benefits of the manner and benefits as previously described for the embodiment of a jacket shown in FIGS. 12A-13. The illustrative embodiment of a jacket 100 shown in FIGS. 14, 15A, & 15B may include two work piece contact surfaces 102 and two recessed portions 103. Generally, the recessed portions 103 may be configured such that they are flush or approximately flush with respect to the contact surface 56*a*' of the dolly 50'.

The work piece contact surfaces 102 may be arranged parallel with respect to one another. Additionally, the recessed portions may be arranged parallel with respect to one another, and the work piece contact surfaces 102 may be arranged perpendicular with respect to the recessed portions 103 (e.g., as opposing edges of a rectangle). This configuration may allow a user to simply slide the dolly 50' in a dimension parallel with respect to the length of the work piece contact surface 102 (and parallel with respect to a surface of the work piece with which the end effector 10' is being used) after the rivet engaged with the contact surface 56*a*' of the dolly 50' has been adequately deformed by providing a passageway through which the rivet nugget/bucktail may pass.

Referring specifically to FIG. 15B, which provides a longitudinal cross-sectional view of an end effector 10' configured with a dolly 50' such as that shown in FIG. 14, the jacket 100 shown in FIGS. 14, 15A, & 15B may be formed with for jacket sides 108 extending away from the contact surface 56*a*' down a portion of the dolly 50'. The jacket 50' may be formed with a jacket ridge 104 on an interior surface of at least one jacket side 108, and in the illustrative embodiment at least two jacket sides 108, and in other embodiments at least three jacket sides 108, and in still other embodiments at least four jacket sides 108. In a manner as previously described in detail above for the jacket 100 shown in FIGS. 12A-13, a jacket ridge 104 may correspond to a contact end groove 56*b*' formed in the contact end 56' of the dolly 10'.

As with the embodiment of the jacket 100 shown in FIGS. 12A-13, in the illustrative embodiment thereof shown in FIGS. 14, 15A, & 15B, the jacket ridge 104 may be configured to slide along the sides of the dolly 50' and then snap into one or more contact end grooves 56*b*' to lock the position of the jacket 100 with respect to the contact surface 56*a*' of the dolly 50'. It is contemplated that in one illustrative embodiment the dolly 50' may be configured with a first set of contact end grooves 56*b*' at a first distance from the contact surface 56*a*' and a second set of contact end grooves 56*b*' at a second distance from the contact surface 56*a*' such that when a jacket ridge 104 is engaged with a first contact end groove 56*b*' the jacket height limit 106 is a first distance and when the jacket ridge 104 is engaged with a second contact end groove 56*b*' the jacket height limit 106 is a second distance. However, other configurations of the contact end grooves 56*b*' may be used without limitation unless otherwise indicated in the following claims.

Generally, the jacket 100 may be configured from various softer, non-metal materials, including but not limited to polymers, plastic urethane, and/or combinations thereof without limitation unless otherwise indicated in the following claims. The jacket 100, and in particular the jacket ridge 104 and contact end groove 56*b*' may be configured with an interference fit, wherein the jacket 100 may stretch/deform to allow insertion of contact end 56' of the dolly 50' into the jacket 100. One of ordinary skill will appreciate that although not shown, in another embodiment the jacket ridge 104 could be configured as a groove and contact end groove 56*b*' could be configured as a ridge without departure from the present disclosure without limitation unless otherwise indicated in the following claims.

Figure 15C:
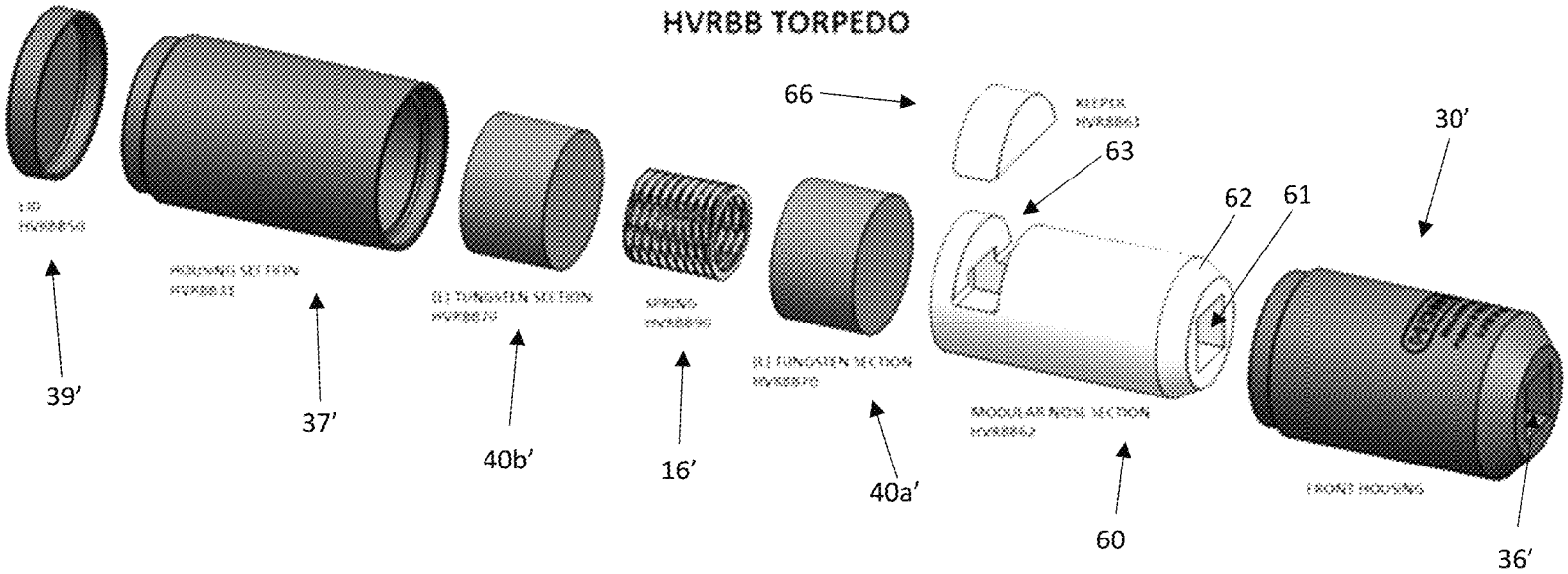
FIG. 15C is an exploded perspective view of the end effector shown in FIGS. 15A & 15B without the dolly.

Referring now to FIGS. 15A-15C, another illustrative embodiment of an end effector 10' may be configured to use an elongate dolly 50', wherein a portion of a shank 52' of the dolly 50' extend outward from a user-grip portion of the end effector 10'. Although the end effector 10' shown in FIGS. 15A & 15B may be used with a jacket 100, other embodiments of an end effector 10' configured according to the present disclosure may be used without a jacket 100 without limitation unless otherwise indicated in the following claims.

The end effector 10' may be configured such that a variety of dollies 50' may be used therewith, including but not limited to the dollies 50' shown in FIGS. 14 and 16A-20G without limitation unless otherwise indicated in the following claims. Referring now specifically to FIGS. 15B & 15C, an exterior portion of the end effector 10' may be comprised of a housing neck 30', which may be engaged with a housing section 37'. A housing section 37' may be engaged with another housing section 37', an end section 38', or a cap 39'. The housing neck 30' may be configured with a neck bore 36' in a first end thereof, wherein a portion of the dolly 50' may extend outwardly through the neck bore 36'

The interior portion of the end effector may be comprised of a nose insert 60 positioned primarily within the housing neck 30'. The nose insert 60 may be configured with a tapered portion 62 adjacent a first end of the nose insert 60 so as to match an internal contour of the housing neck 30'. The nose insert 60 may also be formed with a nose insert bore 61, which may be aligned with the neck bore 36' such that a portion of the dolly 50' may be positioned within the nose insert bore 61. A nose insert keyway 63 may be formed in the nose insert 60 such that the nose insert keyway 63 intersects a portion of the nose insert bore 61 in a perpendicular manner. A keeper 66 may be configured to selectively engage the nose insert keyway 63, and also intersect a portion of the nose insert bore 61 adjacent the nose insert keyway 63. The nose insert 60 and/or keeper 66 may be formed with one or more nose annular grooves 64 into which one or more O-rings 17 may be positioned (as shown at least in FIGS. 17A & 17B), wherein the O-ring(s) 17 may mitigate and/or eliminate unwanted relative movement between the nose section 60 and exterior portion of the end effector 10' and/or between the keeper 66 and exterior portion of the end effector 10' and/or to reduce vibrations and/or kinetic energy transmitted from the end effector 10' to the user without limitation unless otherwise indicated in the following claims.

An intermediate insert 40*a*' may be positioned adjacent the nose insert 60, and a biasing member 16' may be positioned adjacent the intermediate insert 40*a*'. Alternatively, a second intermediate insert 40*a*' may be positioned adjacent the first intermediate insert 40*a*' and the biasing member 16' may be positioned adjacent the second intermediate insert 40*a*' and so on. An end insert 40*b*' may be positioned adjacent the biasing member 16' on an end thereof opposite the intermediate insert 40*a*'. Generally, the biasing member 16 may provide the benefits of and/or function in a manner as previously described above for the end effectors 10 shown in FIGS. 1-10 without limitation unless otherwise indicated in the following claims.

An intermediate insert 40*a*' and/or an end insert 40*b*' may be formed with one or more annular grooves 44' into which one or more O-rings 17 may be positioned (as shown at least in FIGS. 17A & 17B), wherein the O-ring(s) 17 may mitigate and/or eliminate unwanted relative movement between the intermediate and/or end insert 40*a*', 40*b*' and exterior portion of the end effector 10' and/or to reduce vibrations and/or kinetic energy transmitted from the end effector 10' to the user without limitation unless otherwise indicated in the following claims.

In light of the present disclosure, those of ordinary skill in the art will appreciate that the end effectors 10' shown in FIGS. 15A-19C may be configured to utilize a variety of dollies 50', wherein a dolly 50' may be selectively engaged and then disengaged from the other components of the end effector 10'. Generally, an interchangeable dolly 50' may be configured with a shank 51' connecting a first end 54' of the dolly 50' with a contact end 56' of the dolly 50'. The first end 54' may be formed with a keyway 54*a*'. During use, it is contemplated that the first end 54' may be positioned and remain within an interior portion of the end effector 10'. The contact end 56' of the dolly 50' may have any number of configurations, which configurations may be optimized for a specific task. The contact end 56' may be configured with a contact surface 56*a*' for engaging a rivet tail during use. Additionally, the contact end 56' may be configured with a contact end groove 56*b*' as previously described above in detail.

The first end 54' may be configured such that it may be inserted into the interior portion of the end effector 10' through the neck bore 36' and nose insert bore 61. With the keeper 66 removed, the nose insert keyway 63 may be aligned with the keyway 54*a*' of the dolly 50', at which time the keeper 66 may be simultaneously inserted into the nose insert keyway 63 and keyway 54*a*', thereby securing the relative position of the dolly 50' with respect to the nose insert 60. The configuration (e.g., dimensions, shape, etc.) of the outer periphery of the first end 54' and/or shank 52' (or portion thereof) may match the configuration (e.g., dimensions, shape, etc.) of the inner periphery of the neck bore 36' and/or nose insert bore 61 to mitigate and/or eliminate any lateral or other unwanted movement between the dolly 50' and nose insert 60 (which unwanted movement may be primarily in a dimension other than that parallel to the main length of the shank 52') without limitation unless otherwise indicated in the following claims.

Various dollies 50' that may be selectively engaged and disengaged with a nose insert 60 of an end effector 10' as described herein are shown in FIGS. 20A-20G. Although only the dolly 50' pictured in FIG. 20B includes a jacket 100, any dolly 50' may be configured to utilize a jacket 100 as disclosed in detail above without limitation unless otherwise indicated in the following claims. Generally, any dolly 50' with a properly configured shank 52' and/or first end 54' may be used with certain end effectors 10' disclosed herein regardless of the configuration of the contact end 56'. Additionally, the dollies 50' and/or contact ends 56' shown in FIGS. 20A-20G are not meant to be an exhaustive list of the configuration of contact ends 56' that may be used, and the optimal configuration of a contact end 56' will vary from one application to the next depending at least upon rivet size, rivet location with respect to work piece surface, materials of construction of the rivet, and/or other factors without limitation unless otherwise indicated in the following claims.

Figure 17A:
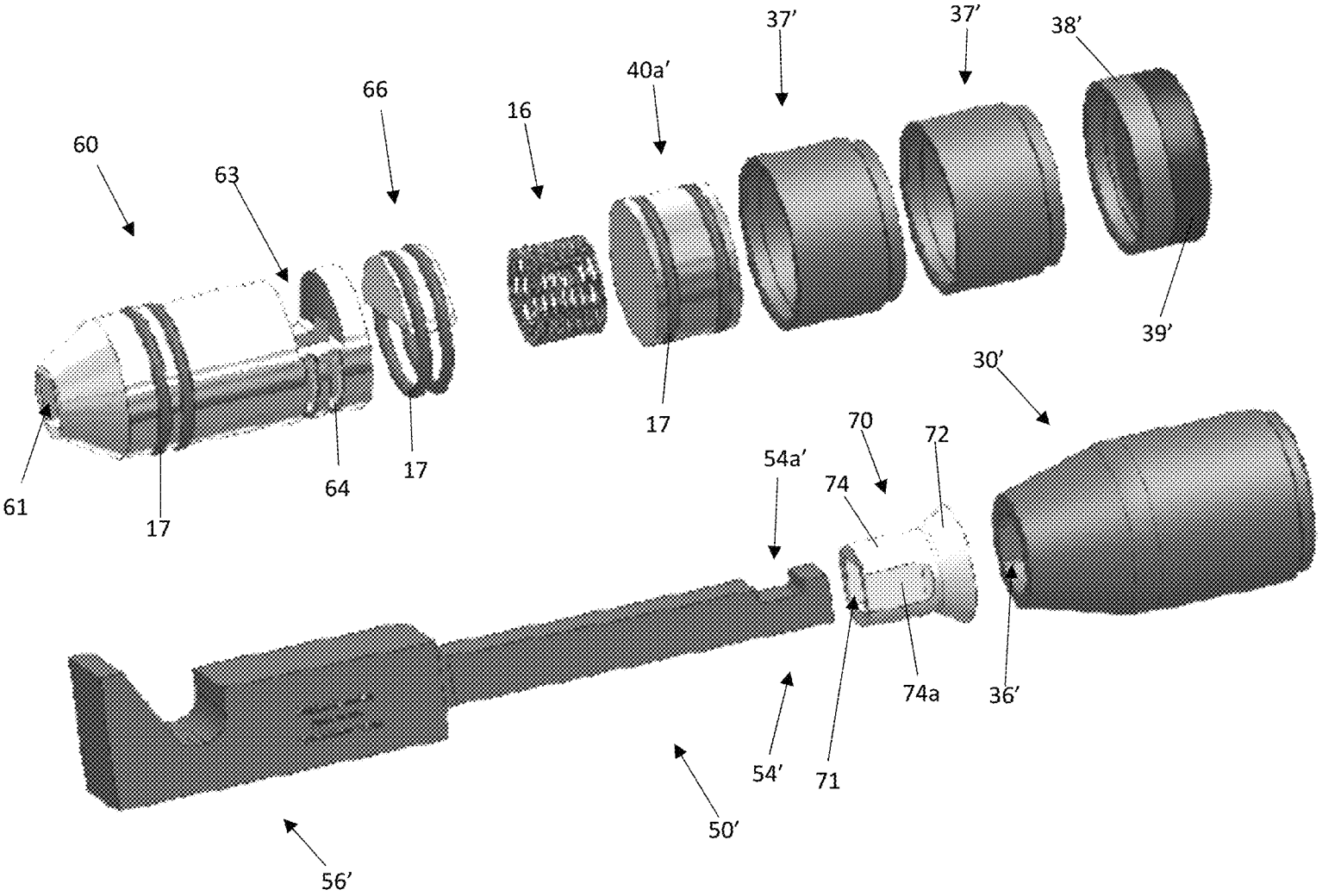
FIG. 17A is an exploded, perspective view of another illustrative embodiment of an end effector.
Figure 17B:
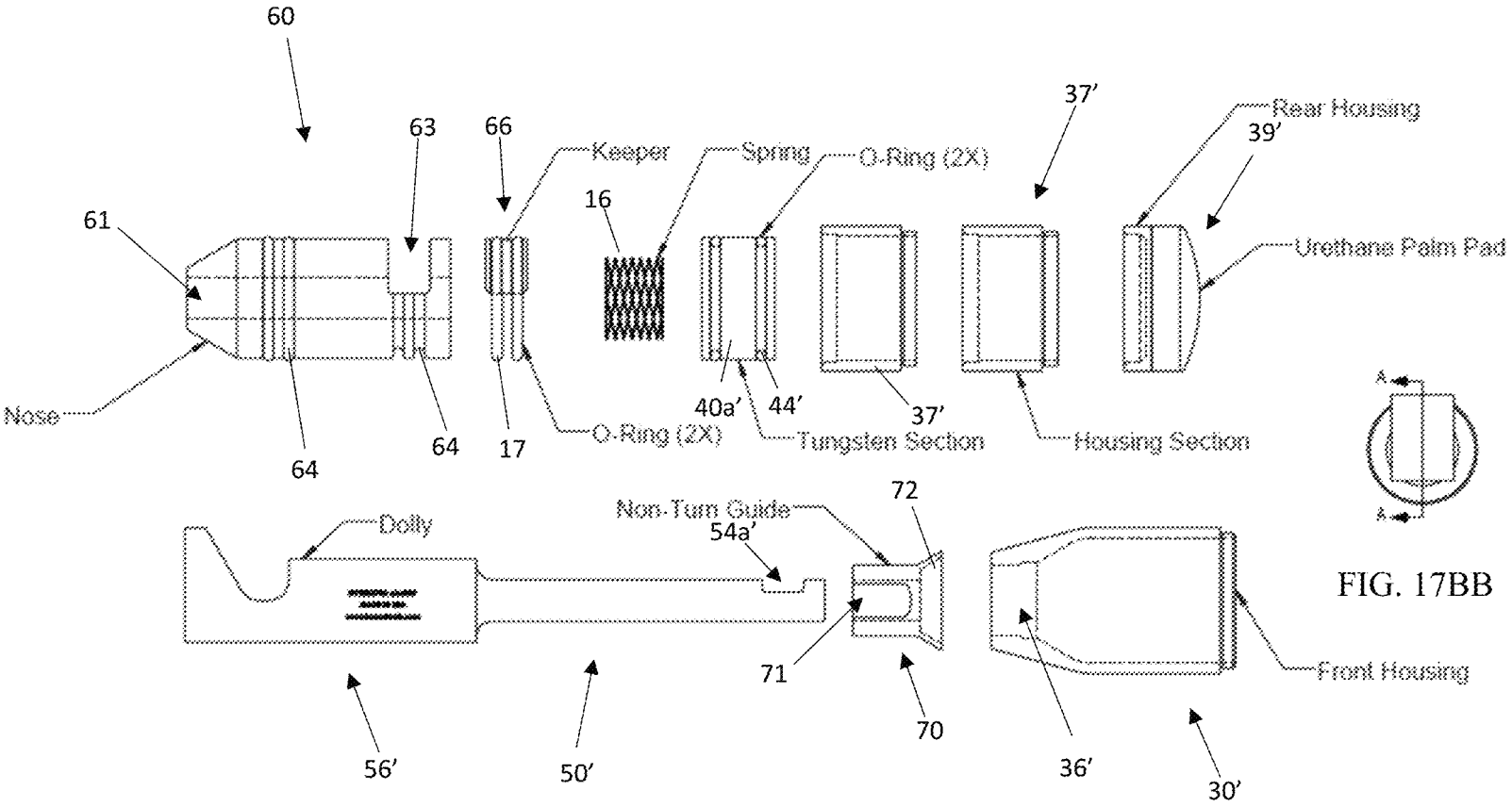
FIG. 17B is an exploded, side view of the embodiment of an end effector shown in FIG. 17A.
Figure 17C:
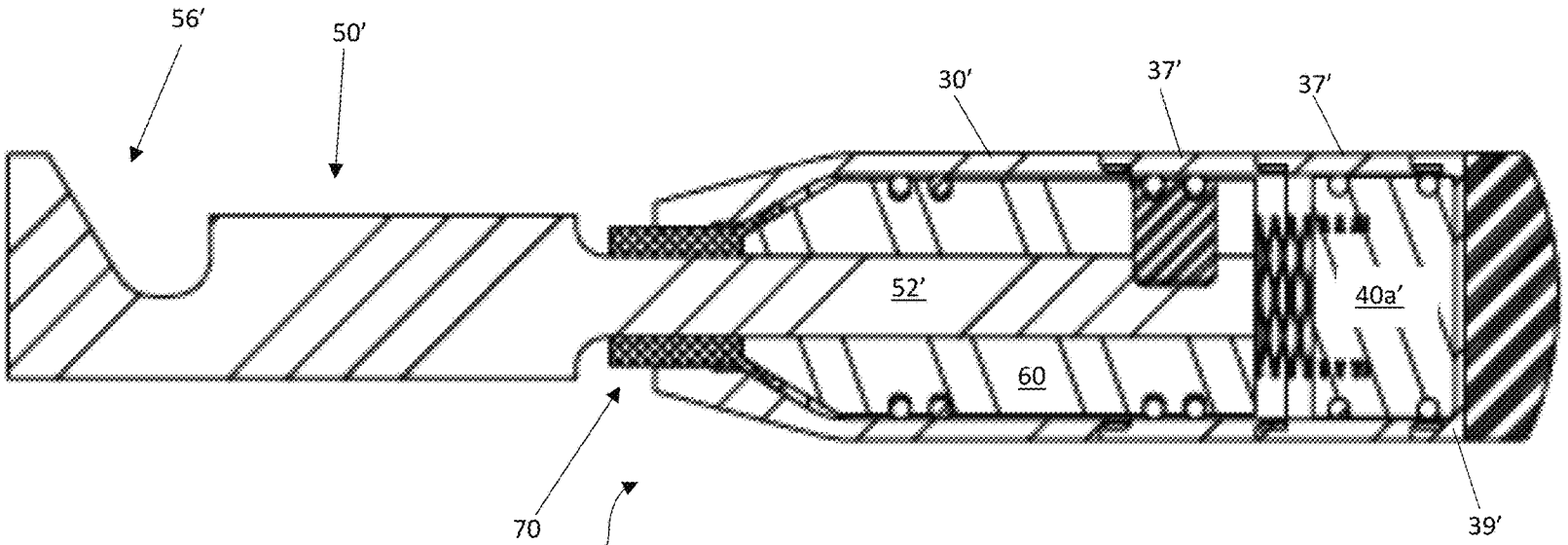
FIG. 17C is a cross-sectional view of the embodiment of an end effector shown in FIGS. 17A-17B.
Figure 18A:
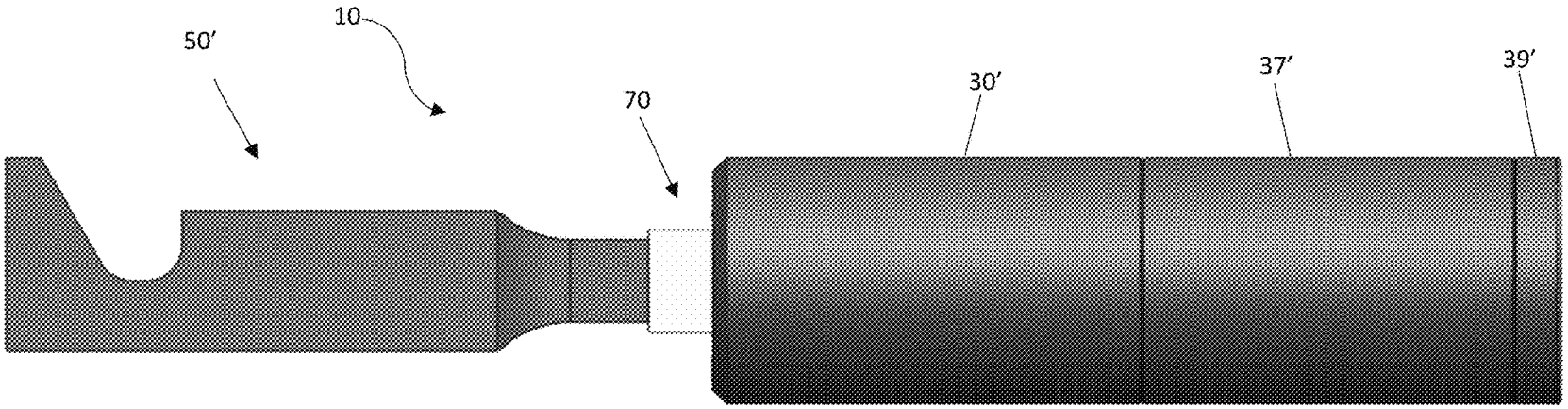
FIG. 18A is a side view of another illustrative embodiment of an end effector.
Figure 18B:
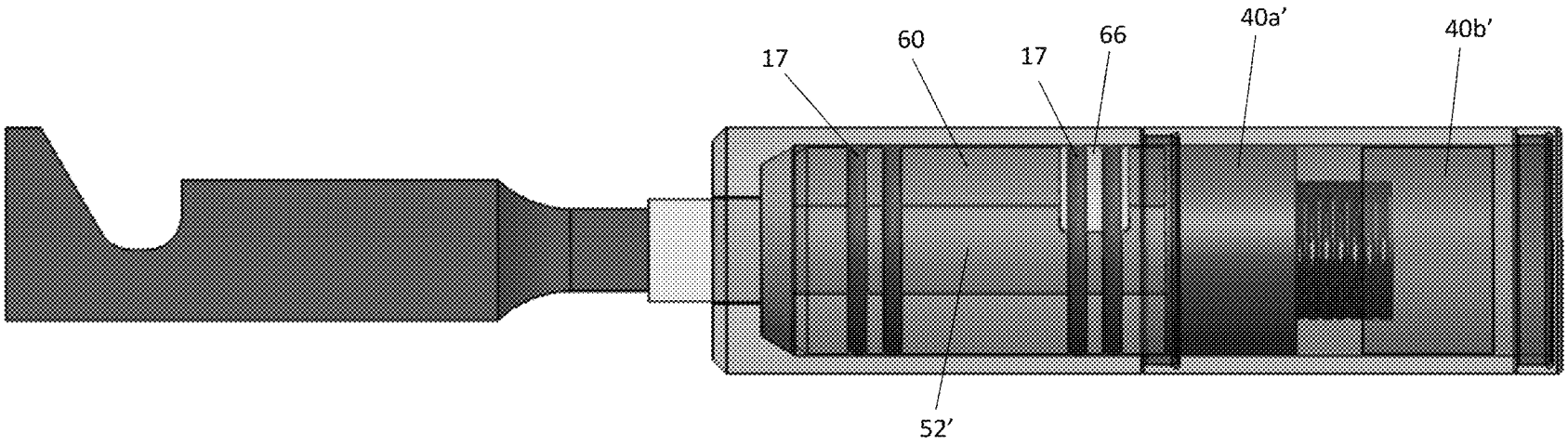
FIG. 18B is a partial cross-sectional view of the embodiment of an end effector shown in FIG. 18A.
Figure 18C:
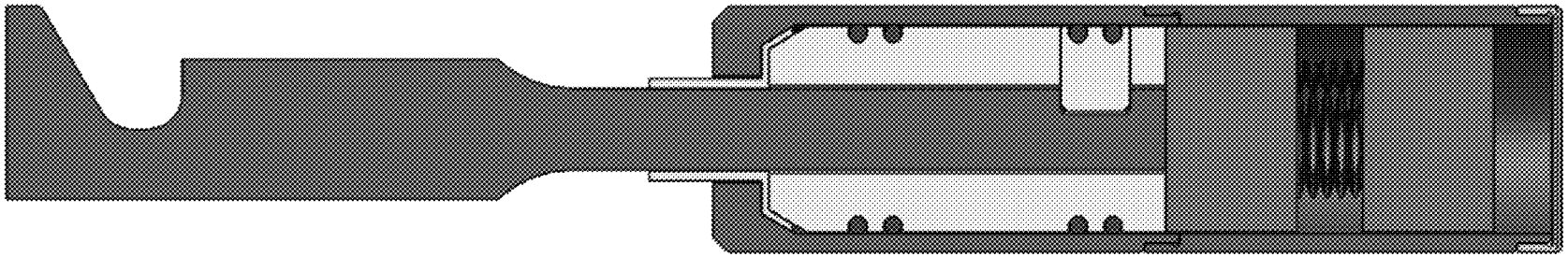
FIG. 18C is a cross-sectional view of the embodiment of an end effector shown in FIGS. 18A & 18B.

In another illustrative embodiment of an end effector 10' shown in FIGS. 17A-17C and an illustrative embodiment shown in FIGS. 18A-18C, the end effector 10' may include a guide member 70 positioned adjacent the neck bore 36'. The guide member 70 include a body 74, which body 74 may be formed with an internal channel 71 through which a portion of the dolly 50' (e.g., the first end 54' and/or a portion of the shank 52') may pass. It is contemplated that the configuration of the internal channel 71 may match the configuration (e.g., dimensions, shape, etc.) of the inner periphery of the nose insert bore 61 and/or outer periphery of the first end 54' and/or shank 52' (or portion thereof).

Referring specifically to FIGS. 17C & 18C, which provide cross-sectional views of two illustrative embodiments of an end effector 10' that includes a guide member 70, the guide member 70 may be positioned within the neck bore 36' such that all or a portion of the flange 72 may be sandwiched between an interior surface of the housing neck 30' and an exterior portion of the nose insert 60. A portion of the body 74 may extend from an interior portion of the housing neck 30' to an exterior portion thereof. Referring now specifically to FIG. 17A, which provides an exploded perspective view of an illustrative embodiment of an end effector 10', one or more sides of the body 74 may be formed with a flat portion 74*a*, which may correspond to a flat portion formed on an interior surface of the housing neck 30' at or adjacent to the neck bore 36'. It is contemplated that for certain applications the guide member 70 may mitigate and/or eliminate angular misalignment (e.g., rocking, wobbling, etc.) between the dolly 50' and other portions of the end effector 10' (e.g., nose insert 60, intermediate insert 40*a*', etc.) without limitation unless otherwise indicated in the following claims.

Figure 16A:
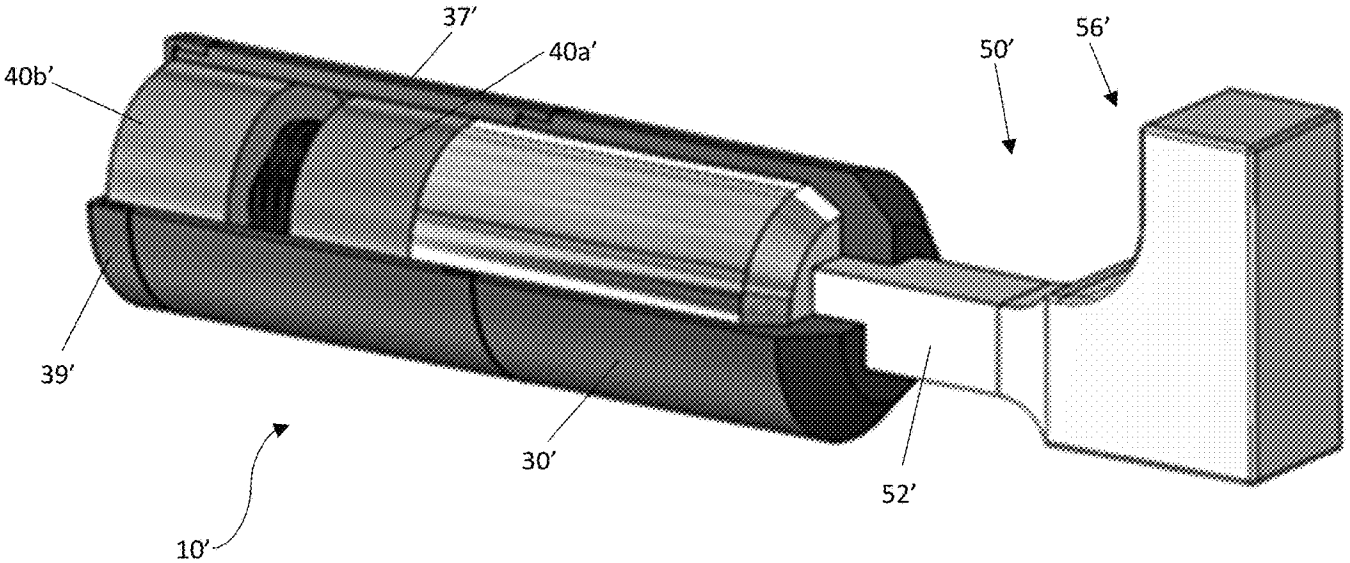
FIG. 16A is a perspective cutaway view of an end effector similar to those shown in FIGS. 15A-C utilizing another illustrative embodiment of a dolly.
Figure 16B:
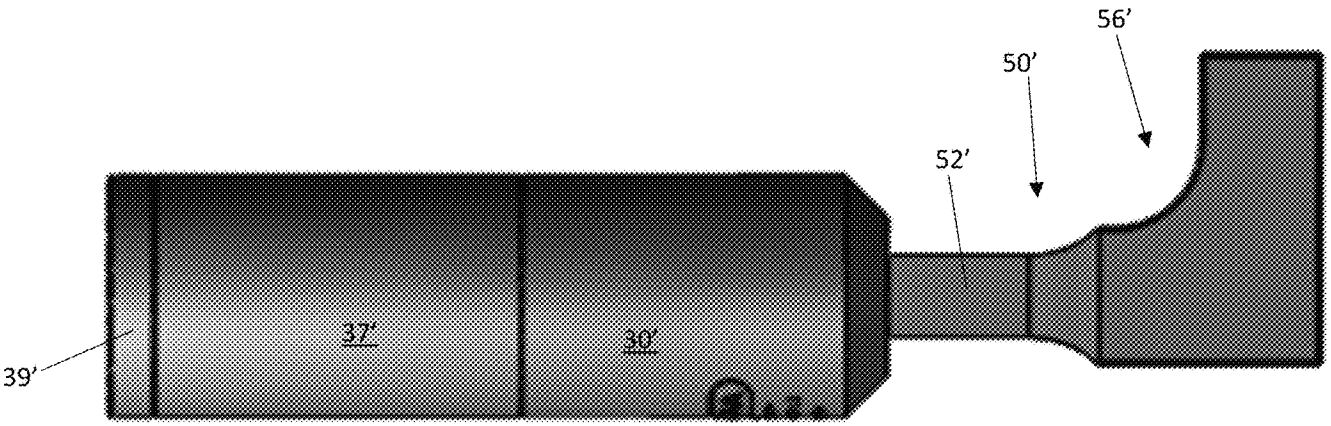
FIG. 16B is a side view of the end effector shown in FIG. 16A
Figure 19A:
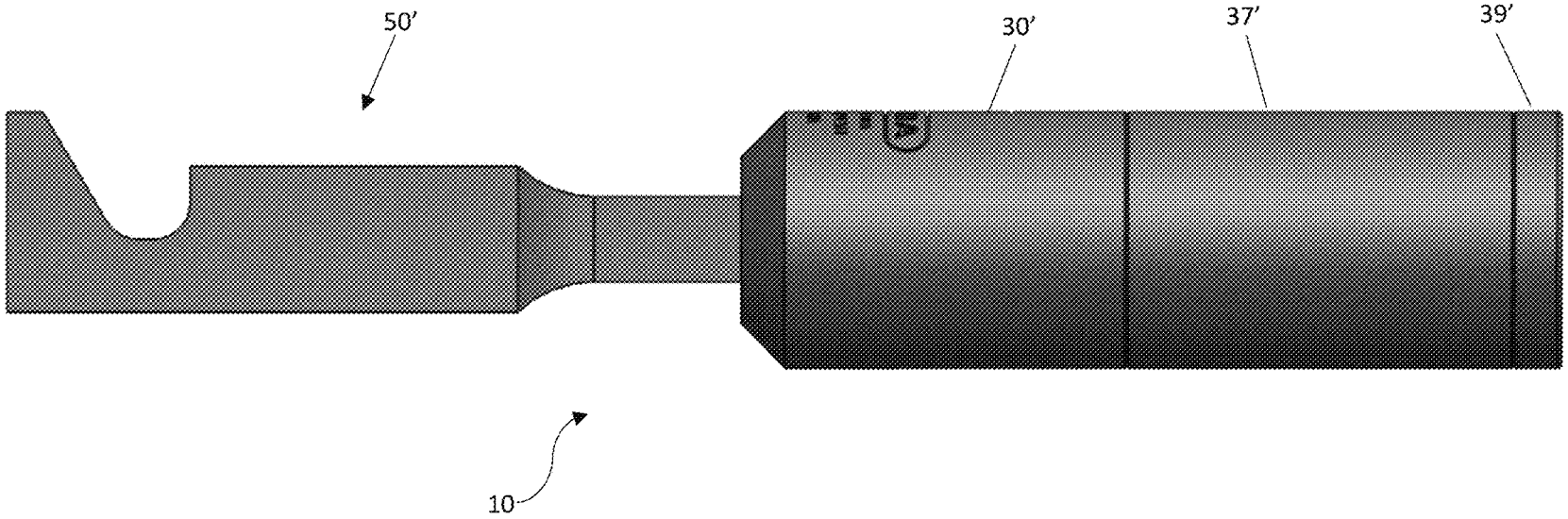
FIG. 19A is a side view of another illustrative embodiment of an end effector.
Figure 19B:
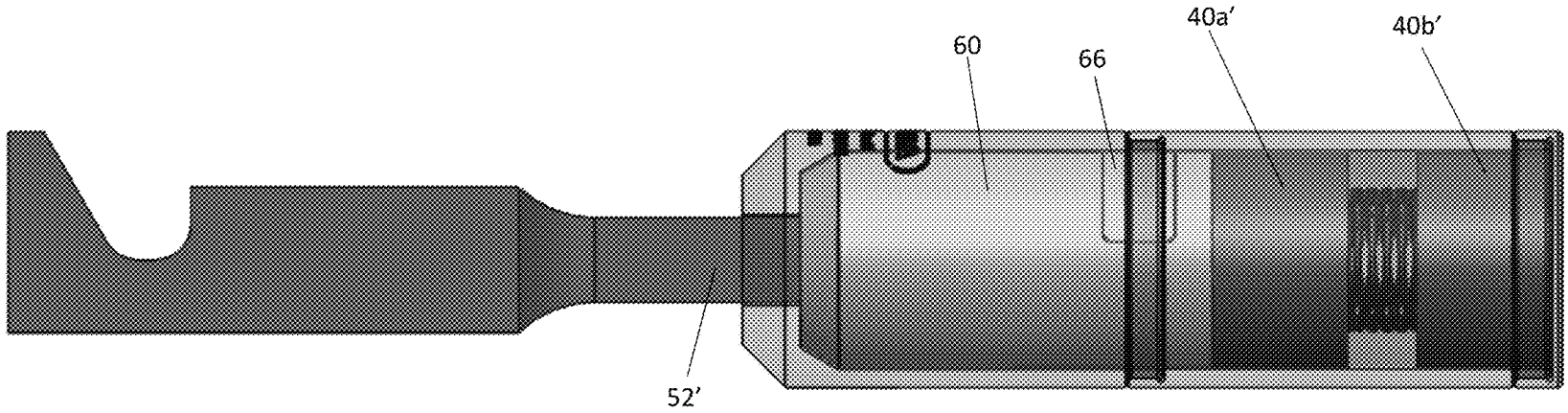
FIG. 19B is a partial cross-sectional view of the embodiment of an end effector shown in FIG. 19A.
Figure 19C:
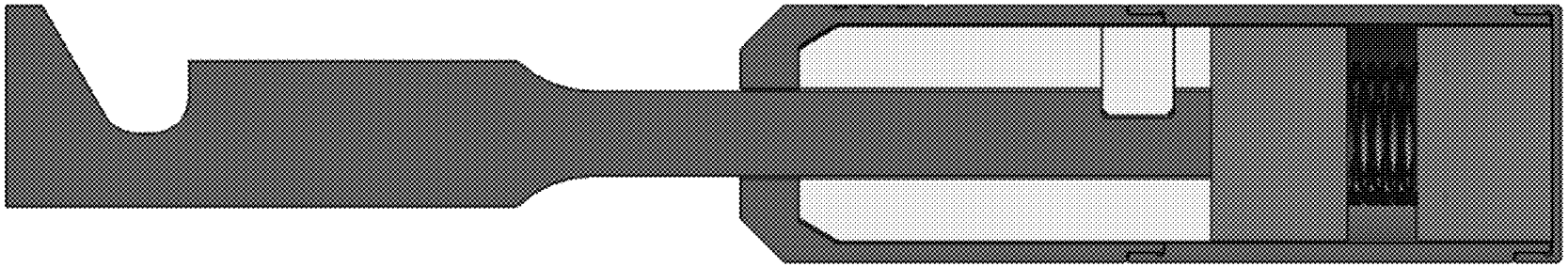
FIG. 19C is a cross-sectional view of the embodiment of an end effector shown in FIGS. 19A & 19B.
Figures 20A, 20B, 20C, 20D:
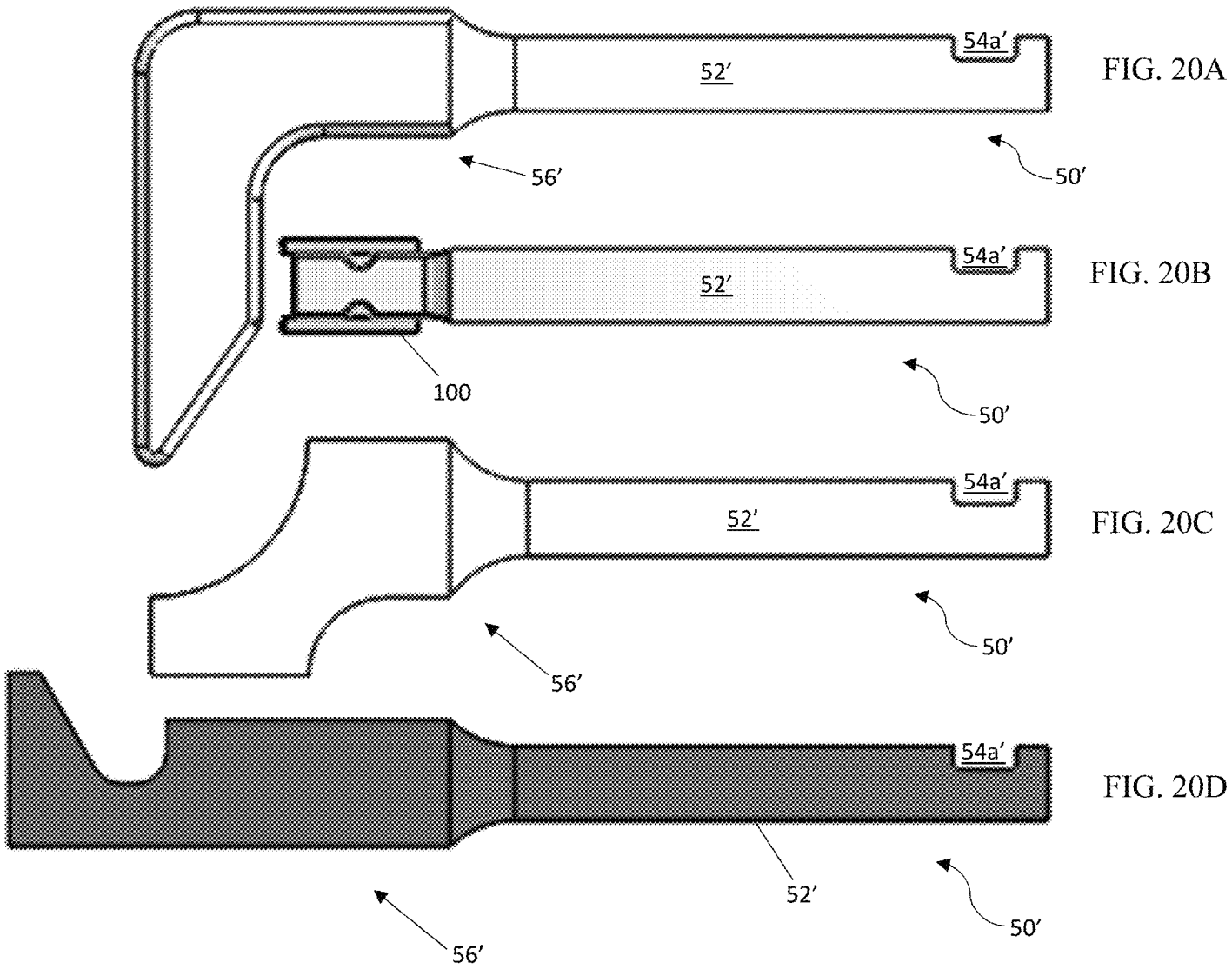
FIGS. 20A-20G provide side views of various dollies that may be used in certain illustrative embodiments of end effectors.
Figure 20E:
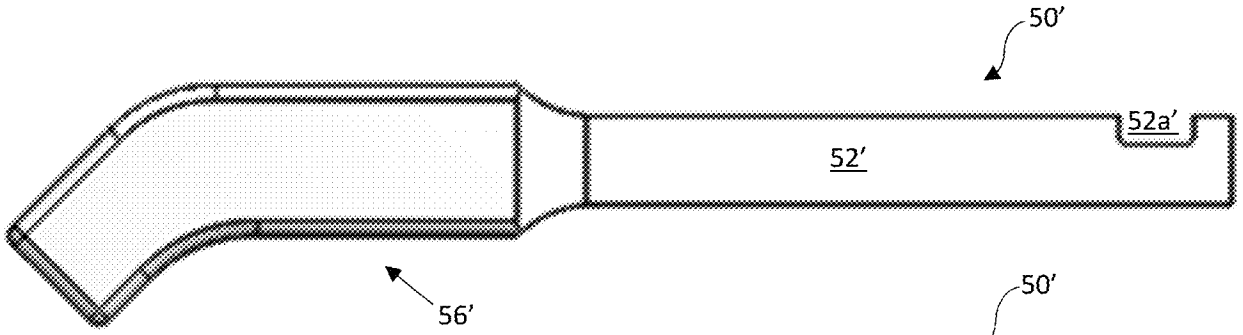
Figure 20F:
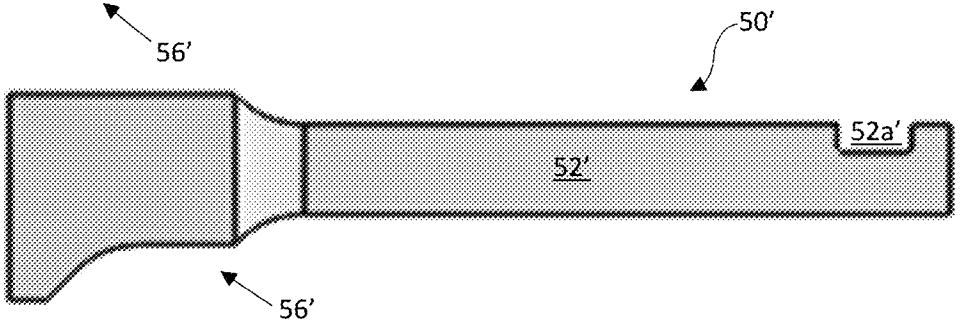
Figure 20G:
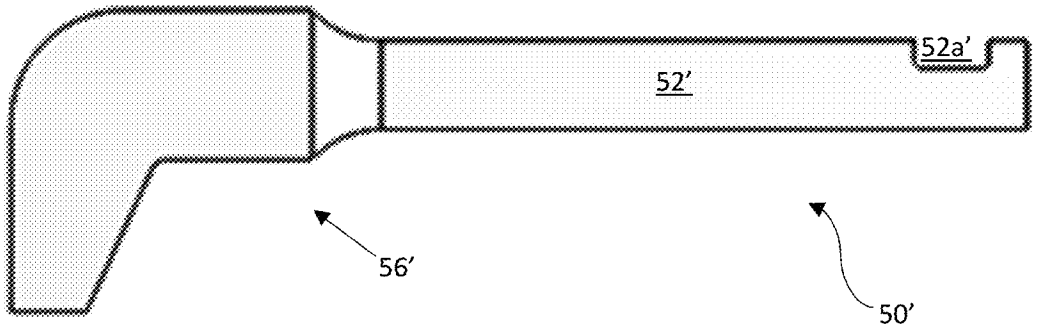

As evidenced by the illustrative embodiment of the end effector 10' shown in FIGS. 15A-15C, the illustrative embodiment shown in FIGS. 16A & 16B, the illustrative embodiment shown in FIGS. 17A-17C, the illustrative embodiment shown in FIGS. 18A-18C, and the illustrative embodiment shown in FIGS. 19A-19C, an end effector 10' utilizing a dolly 50' may be configured such that the weight of the end effector 10' may be varied and/or adjusted to suit a particular application. For example and by way of illustration but without limitation unless otherwise indicated in the following claims, the end effector 10' shown in FIGS. 17A-17C may be configured to accept multiple intermediate inserts 40*a*' in addition to an end insert 40*b*' by increasing the number of housing sections 37', thereby increasing the overall length of the end effector 10'. Generally, an increased number of inserts 40*a*', 40*b*' may lead to increased weight.

The optimal weight of the end effector 10' (and consequently, the optimal weight, size, material of construction, and number of intermediate inserts 40*a*' and/or end inserts 40*b*') will vary from one application to the next. However, it is contemplated that generally, when used with relatively larger rivets and/or those constructed of relatively harder and/or stronger material (e.g., titanium) a relatively heavier end effector 10' may be advantageous. Conversely, when used with relatively smaller rivets and/or rivets constructed of a relatively softer material (e.g., aluminum) a relatively lighter end effector 10' may suffice. Accordingly, the scope of the present disclosure is in no way limited by the may It is contemplated that for many applications it may be desirable to position a biasing member 16 between the intermediate insert 40*a*' closest to the cap 39' and the end insert 40*b*', but other configurations may be used without limitation unless otherwise indicated in the following claims. It is It is contemplated that the various elements of the end effector 10', 110 (e.g., housing neck 30', housing section 37', end section 38', cap 39', nose insert 60, keeper 66, intermediate insert 40*a*', end insert 40*b*', biasing member 16', dolly 50', work end 112, grip portion 114, etc.) may be comprised of any material suitable for the particular application of the end effector 10', 110, which materials include but are not limited to metals and their alloys (e.g., steel, titanium, tungsten, etc.), polymer materials, ceramic materials, and/or combinations thereof without limitation unless otherwise indicated in the following claims, and the optimal material may vary from one application of the end effector 10', 110 to the next. It is also contemplated that the guide member 70 may also be comprised of any suitable material, including but not limited to metals and their alloys, plastics, polymers, natural materials, and/or combinations thereof without limitation unless otherwise indicated in the following claims.

Although the illustrative apparatuses and processes described and disclosed herein may be configured for use with rivets comprised primarily of metallic materials and their alloys, the scope of the present disclosure is not so limited so and extends to any beneficial and/or advantageous use and/or configuration thereof without limitation unless so indicated in the following claims.

The materials used to construct the apparatuses and/or components thereof may vary depending on the specific application thereof, but it is contemplated that polymers, synthetic materials, metals, metal alloys, natural materials, and/or combinations thereof may be especially useful in some applications. Accordingly, the above-referenced elements may be constructed of any material known to those skilled in the art or later developed, which material is appropriate for the specific application of the present disclosure without departing from the spirit and scope of the present disclosure unless so indicated in the following claims.

Having described preferred aspects of the various processes and apparatuses, other features of the present disclosure will undoubtedly occur to those versed in the art, as will numerous modifications and alterations in the embodiments and/or aspects as illustrated herein, all of which may be achieved without departing from the spirit and scope of the present disclosure. Accordingly, the apparatuses and methods and/or embodiments thereof as pictured and described herein are for illustrative purposes only, and the scope of the present disclosure extends to all processes, apparatuses, and/or structures for providing the various benefits and/or features of the present disclosure unless so indicated in the following claims, such as all similar apparatuses for mitigating and/or reducing the frequency, intensity, and/or number of vibrations and/or energy transmitted from an end effector 10, 10', 110 to a user during operation of the end effector 10, 10', 110, generally reducing the kinetic energy transmitted to a user during operation of an end effector 10, 10', 110, offering an end effector 10, 10', 110 that may be adapted for use in multiple application, and/or providing an end effector 10, 10', 110 that reduces the likelihood that a rivet 12 is improperly placed and/or modified as the distal end 12*c* of the rivet 12 (the nugget/bucktail), including using jacket 100 as suitable for the application.

While various apparatuses and methods according to the present disclosure have been described in connection with preferred aspects and specific examples, it is not intended that the scope be limited to the particular embodiments and/or aspects set forth, as the embodiments and/or aspects herein are intended in all respects to be illustrative rather than restrictive. Accordingly, the processes and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the apparatuses and methods disclosed herein are not limited to the specific embodiments pictured and described herein, but rather the scope of the inventive features according to the present disclosure is defined by the claims herein. Modifications and alterations from the described embodiments will occur to those skilled in the art without departure from the spirit and scope of the present disclosure.

Any of the various features, components, functionalities, advantages, aspects, configurations, process steps, process parameters, etc. of the apparatuses and methods disclosed herein may be used alone or in combination with one another depending on the compatibility of the features, components, functionalities, advantages, aspects, configurations, process steps, process parameters, etc. Accordingly, a nearly infinite number of variations of the present disclosure exist. Modifications and/or substitutions of one feature, component, functionality, aspect, configuration, process step, process parameter, etc. for another in no way limit the scope of the present disclosure unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

Unless otherwise expressly stated in the claims, it is in no way intended that any process or method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

The invention claimed is:

1. An end effector comprising:

a. a housing neck having a neck bore along a length of said housing neck;

b. a housing section having a first end and a second end, wherein said housing section is engaged with said housing neck at said first end of said housing section, and wherein an insert and a second insert are positioned within said housing;

c. a nose insert positioned within said housing neck, wherein said nose insert comprises:

i. a nose insert bore formed along a length of said nose insert;

ii. a nose insert keyway formed adjacent an end of said nose insert, wherein a portion of said nose insert keyway intersects said nose insert bore; and, iii. a keeper selectively engageable with said nose insert keyway;

d. a dolly engaged with said nose insert, wherein said dolly comprises:

i. a first end positioned within said nose insert;

ii. a contact end extending from said housing neck; and, iii. a shank connecting said first end with said contact end.

2. The end effector according to claim 1 further comprising a cap engaged with said second end of said housing section.

3. The end effector according to claim 1 wherein said dolly first end further comprises a keyway, wherein said keyway is alignable with said nose insert keyway such that said keeper is selectively engageable with said keyway.

4. The end effector according to claim 1 wherein said dolly further comprises a contact end groove formed on said contact end.

5. The end effector according to claim 4 wherein said end effector further comprises a biasing member positioned between said nose insert and an intermediate insert.

6. The end effector according to claim 5 wherein said end effector further comprises a second biasing member positioned between said insert and said second insert.

7. The end effector according to claim 1 wherein said end effector further comprises a sleeve positioned of an exterior portion of said housing section.

8. The end effector according to claim 1 wherein said dolly contact end further comprises a jacket engaged therewith, wherein said jacket surrounds a portion of a contact surface formed on said contact end of said dolly.

9. The end effector according to claim 8 wherein said jacket is further defined as comprising:

a. at least three jacket sides connected with one another to form an enclosed periphery;

b. a work piece contact surface extending away from at least one said jacket side; and, c. a jacket ridge formed on an interior surface of at least one said jacket side.

10. The end effector according to claim 9 wherein a distance between said work piece contact surface of said jacket and said contact surface is defined as a jacket height limit.

11. The end effector according to claim 10 wherein said contact end of said dolly further comprises a contact end groove, and wherein said contact end groove corresponds to said jacket ridge.

12. The end effector according to claim 11 wherein said jacket further comprises:

a. a second work piece contact surface, wherein said work piece contact surface and said second work piece contact surface are oriented parallel with respect to one another; and, b. a recessed portion, wherein said recessed portion is oriented perpendicularly with respect to said work piece contact surface and said second work piece contact surface.

* * * * *